US012078413B2

(12) United States Patent
Beckman et al.

(10) Patent No.: US 12,078,413 B2
(45) Date of Patent: Sep. 3, 2024

(54) RAPID DELIVERY, STORAGE AND MANAGEMENT OF FRESH PERSONAL CARE PREPARATIONS

(71) Applicants: Christopher V. Beckman, Los Angeles, CA (US); Zaneta Beckman, Los Angeles, CA (US)

(72) Inventors: Christopher V. Beckman, Los Angeles, CA (US); Zaneta Beckman, Los Angeles, CA (US)

(73) Assignee: GEMTERA INC., Nokomis, FL (US)

( * ) Notice: Subject to any disclaimer, the term of this patent is extended or adjusted under 35 U.S.C. 154(b) by 336 days.

(21) Appl. No.: 17/189,236

(22) Filed: Mar. 1, 2021

(65) Prior Publication Data

US 2021/0293473 A1 Sep. 23, 2021

Related U.S. Application Data

(60) Provisional application No. 62/983,577, filed on Feb. 28, 2020.

(51) Int. Cl.
*F25D 29/00* (2006.01)
*F25D 25/02* (2006.01)

(52) U.S. Cl.
CPC ..... *F25D 29/00* (2013.01); *F25D 25/02* (2013.01); *F25D 2400/36* (2013.01); *F25D 2700/06* (2013.01); *F25D 2700/14* (2013.01)

(58) Field of Classification Search
CPC ..... F25D 2700/06
See application file for complete search history.

(56) References Cited

U.S. PATENT DOCUMENTS 4,481,785 A * 11/1984 Tershak ..... F25D 21/006 62/155
2017/0219279 A1* 8/2017 Chae ..... G01K 1/024
2018/0239319 A1* 8/2018 Abdoo ..... G05B 19/042
2021/0364226 A1* 11/2021 Park ..... F25D 29/00

* cited by examiner

*Primary Examiner* — Nelson J Nieves
*Assistant Examiner* — Meraj A Shaikh

(57) ABSTRACT

New systems, devices and methods for manufacturing, preparing, rapidly transporting, and managing personal care products including fluid(s), lotion(s), gel(s), powder(s), solid(s) are provided. In some such embodiments, new forms of personal care product containers are provided for such preparations. For example, in some embodiments, new forms of flat-packed, convertible personal care fluid containers are provided. In some embodiments, some such personal care fluid containers include a plurality of chambers for segregating and then mixing different personal fluid ingredients. In some embodiments, a usage-tracking personal care container shelf system is provided, comprising personal care routine monitoring and application tools. In some embodiments, the usage-tracking personal care container shelf system scans, stores and preserves personal care fluids within a plurality of individually temperature-regulated compartments, and aids users in managing their personal care routines.

19 Claims, 13 Drawing Sheets

RAPID DELIVERY, STORAGE AND MANAGEMENT OF FRESH PERSONAL CARE PREPARATIONS

CROSS-REFERENCE TO RELATED APPLICATION

This application claims the benefit of U.S. Provisional Application No. 62/983,577, filed Feb. 28, 2020, entitled "Body Care and Health Improvements," the entire contents of which are hereby incorporated by reference into the present application as if fully set forth herein.

TECHNICAL FIELD

The present invention relates to the field of creation, manufacturing, packaging, shipping and administration of personal care products and managing personal care routines. The present application also relates to the fields of computer science, including specialized computer hardware, computer software, and GUIs controlling aspects of any and all of those technical areas.

BACKGROUND

Some of the inventions set forth in this application relate to aspects of personal care, including personal care products, such as cleansers, lotions, creams, soaps, shampoos, butters, astringents, polishes, exfoliators, nutrients, creams, oils, botanicals, minerals, fragrances, salves, bleaches, depilatories, conditioners, sunscreen, anti-inflammatories, clarifiers, cosmetics and/or moisturizers. Such personal care products may be, or include, preparations including fluid, gel, powder and/or solid ingredients. Cosmetics and other personal care products date to at least ancient Egypt, some 7,000 years ago. In recent times, such products have been delivered to consumers in glass or plastic bottles, typically, in the range of 4 to 16 ounces, or more, for storage at home and use in their daily personal care routine.

The use of toothbrushes and toothpastes is one form of personal care. The toothbrush and toothpaste industry relates to the sub-fields of personal hygiene, beautification and health enhancement. Aspects of inventions set forth in the present application relate to new types of toothbrushes and toothpastes.

Although the modern toothbrush did not spread throughout Europe until the 1600s, teeth- and gum-cleaning implements have been in use for many centuries, and date before recorded history. Typically, in the modern era, a toothbrush includes a handle connected to a set of round-ended, flexible bristles, and is used with toothpaste or other dentifrice and water to clean teeth and gums. In the United States, toothpastes usually include a soap for cleaning and a fluoride compound, for its anti-cavity and pro-mineralization properties to protect teeth from decay. Toothpastes are usually not ingested, and some may even be poisonous to ingest, but some "natural ingredients," such as enzymatic and other toothpaste alternatives, have been developed that may be safer for animals to ingest. Although the safety and efficacy of many specific dentifrices may be debated, the overall health and hygiene benefits of brushing teeth with a toothbrush and a dentifrice is widely accepted and is part of the ordinary routine of a vast majority of people in the most developed countries.

In recent years, electric toothbrushes have been created, which include a motor or another type of actuator, to agitate bristles. Some electric toothbrushes operate at extremely high rates of vibration or other oscillation, but move bristles a relatively small distance with each oscillation. A user may brush their teeth normally, but not notice any particular movement due to this high rate of speed and small distance. Some electric toothbrushes with an oscillation rate in the range of sound audible to humans (roughly 20 to 20,000 Hertz, or cycles per second) are referred to as "sonic" toothbrushes. Some "ultrasonic" electric toothbrushes have also been created, with an oscillation rate above 20,000 Hertz. A variety of claims have been made regarding the increased efficacy of sonic and ultrasonic electric toothbrushes, above manual and lower-rate electric toothbrushes, for removal of plaque. Plaque is a build-up of bacteria in a film covering teeth which, if not removed, leads to an increased risk of dental decay and disease, and halitosis. Some dentists advise the use of a fluoride mouthwash, as well as brushing and flossing, to prevent the build-up of plaque.

Some advanced electric toothbrushes offer timing functions, indicating an amount of time for brushing teeth (typically, two (2) minutes per brushing session).

It should be noted that some of the disclosures set forth as background, such as, but not limited to, the above language under the heading "Background," do not relate exclusively to prior art and the state of the art in the field(s) of the invention, and should not be construed as an admission with respect thereto.

SUMMARY OF THE INVENTION

New systems, devices and methods for manufacturing, preparing, rapidly transporting, and managing personal care products including fluid(s), lotion(s), gel(s), powder(s), solid(s) are provided. In some such embodiments, new forms of personal care product containers are provided for such preparations. For example, in some embodiments, new forms of flat-packed, convertible personal care fluid containers are provided. In some embodiments, some such personal care fluid containers include a plurality of chambers for segregating and then mixing different personal fluid ingredients. In some embodiments, a usage-tracking personal care container shelf system is provided, comprising personal care routine monitoring and application tools. In some embodiments, the usage-tracking personal care container shelf system scans, stores and preserves personal care fluids within a plurality of individually temperature-regulated compartments, and aids users in managing their personal care routines. In some embodiments, a personal care fluid refrigerator, comprising GUI-presentation tools (e.g., via touchscreen displays) is provided, which scans, stores and preserves personal care fluids within a plurality of specialized compartments, and aids user's in managing their personal care routines.

In some embodiments, techniques for rapidly supplying pure cosmetics and body care micro-supply are provided. In some such embodiments, some such personal care fluid containers include a plurality of chambers for segregating and then mixing different personal fluid ingredients.

New systems, devices, methods and other techniques for oral care are also provided. In some embodiments, new forms of electric or other motorized toothbrushes and/or brushing heads are provided, which surround, conform to, and penetrate a user's teeth, gumline and other aspects of a user's mouth and oral cavity. In some such embodiments, a new form of brushing head is provided with multiple teeth-accepting channels. In some such embodiments, such channels are provided in a cross pattern. In some such embodiments, each channel is configured to accept a different set of teeth. For example, in some embodiments, a first channel is wider than a second channel, and the first channel is adapted to accept, clean and treat a user's back teeth (e.g., molars) and associated gums, while the second channel is adapted to accept, clean and treat a user's front teeth (e.g., incisors) and associated gums. In some embodiments, a "BUTTERFLY" format brushing head is provided, including one or more such teeth-accepting channels, defined in part by at least two flexible arms lined with brushes and bristles. In some such embodiments, the sides of at least one of the two flexible arms clean and/or treat the user's teeth while applying a constant pressure, and adjusting to different size teeth placed within that channel. In related methods of use, a user is provided with an electric toothbrush with a multiple-channel brushing head, and transitions from covering one set of teeth to another set of teeth with a single, continuous movement, brushing all of her or his teeth.

As mentioned above, the techniques may include methods and systems, in some embodiments. In some embodiments, such systems include computer hardware and software, including non-transitory machine-readable media with executable instructions. When executed by computer hardware, the instructions may cause the systems to carry out any or all of the methods set forth in this application.

This Application references co-pending U.S. patent application Ser. No. 16/533,757, filed Aug. 6, 2019, and its related U.S. Patent Applications—namely, U.S. patent application Ser. No. 15/603,433, filed May 23, 2017 (now U.S. Pat. No. 10,368,632), U.S. patent application Ser. No. 14/860,692, filed Sep. 21, 2015 (now U.S. Pat. No. 9,655,704) and U.S. patent application Ser. No. 13/570,241, filed Aug. 8, 2012 (now U.S. Pat. No. 9,138,304). All of the disclosures of the above applications are hereby incorporated by reference, as if fully set forth herein.

These and other aspects of the invention will be set forth in greater detail below, in other parts of this application. This Summary, the Abstract, and other parts of the application, are for ease of understanding only, and no part of this application should be read to limit the scope of any other part, nor to limit the scope of the invention, whether or not it references matter in any other part.

It should be noted that the figures referenced above are examples only of the wide variety of different embodiments falling within the scope of the invention, as will be readily apparent to those skilled in the art. Thus, any particular size(s), shape(s), proportion(s), scale(s), material(s) or number(s) of elements pictured are illustrative and demonstrative, and do not limit the scope of invention, as will be so readily apparent.

DETAILED DESCRIPTION OF THE INVENTION

Figure 1:
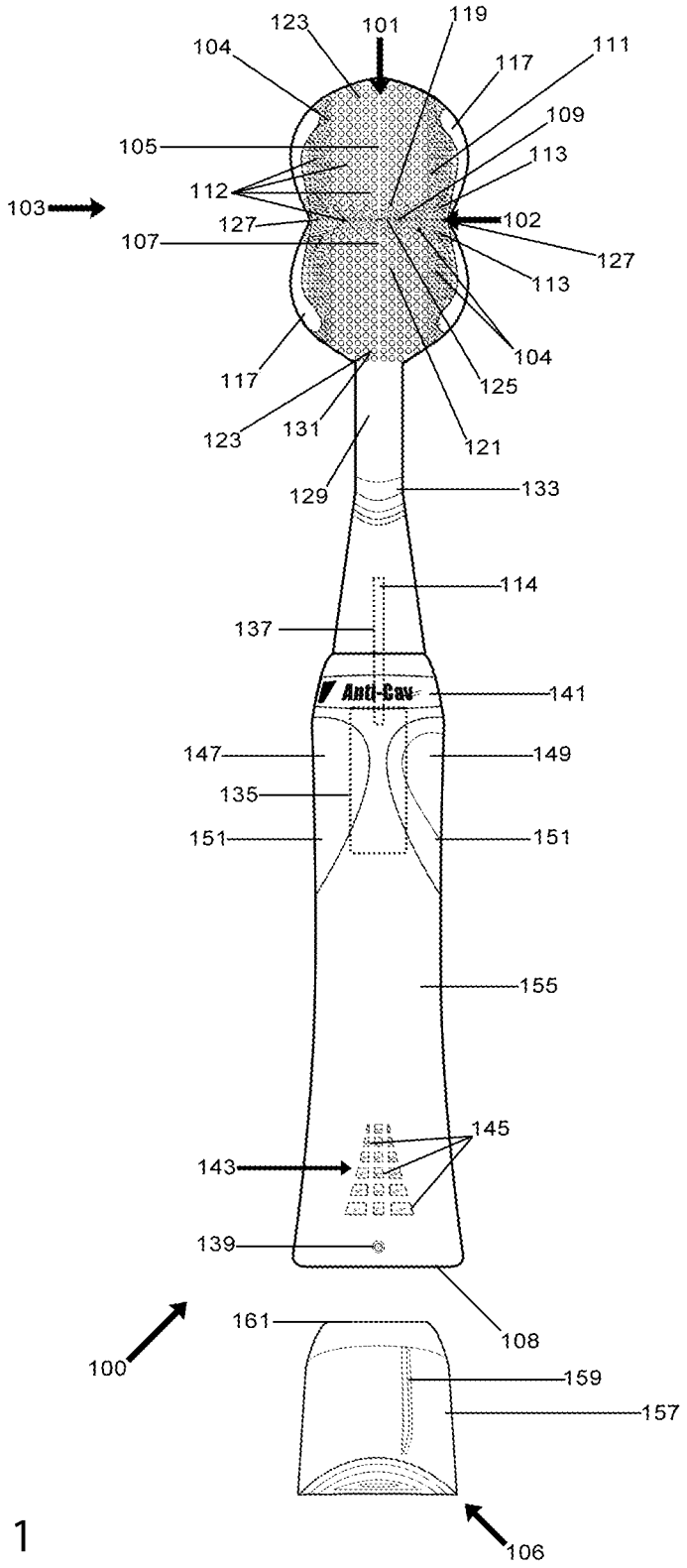
FIG. 1 is a front view of an example electric oral care device with a new form of tooth- and gum-surrounding brushing head, along with an example cartridge and cartridge-loading compartment, in accordance with aspects set forth in this application.
Figure 2:
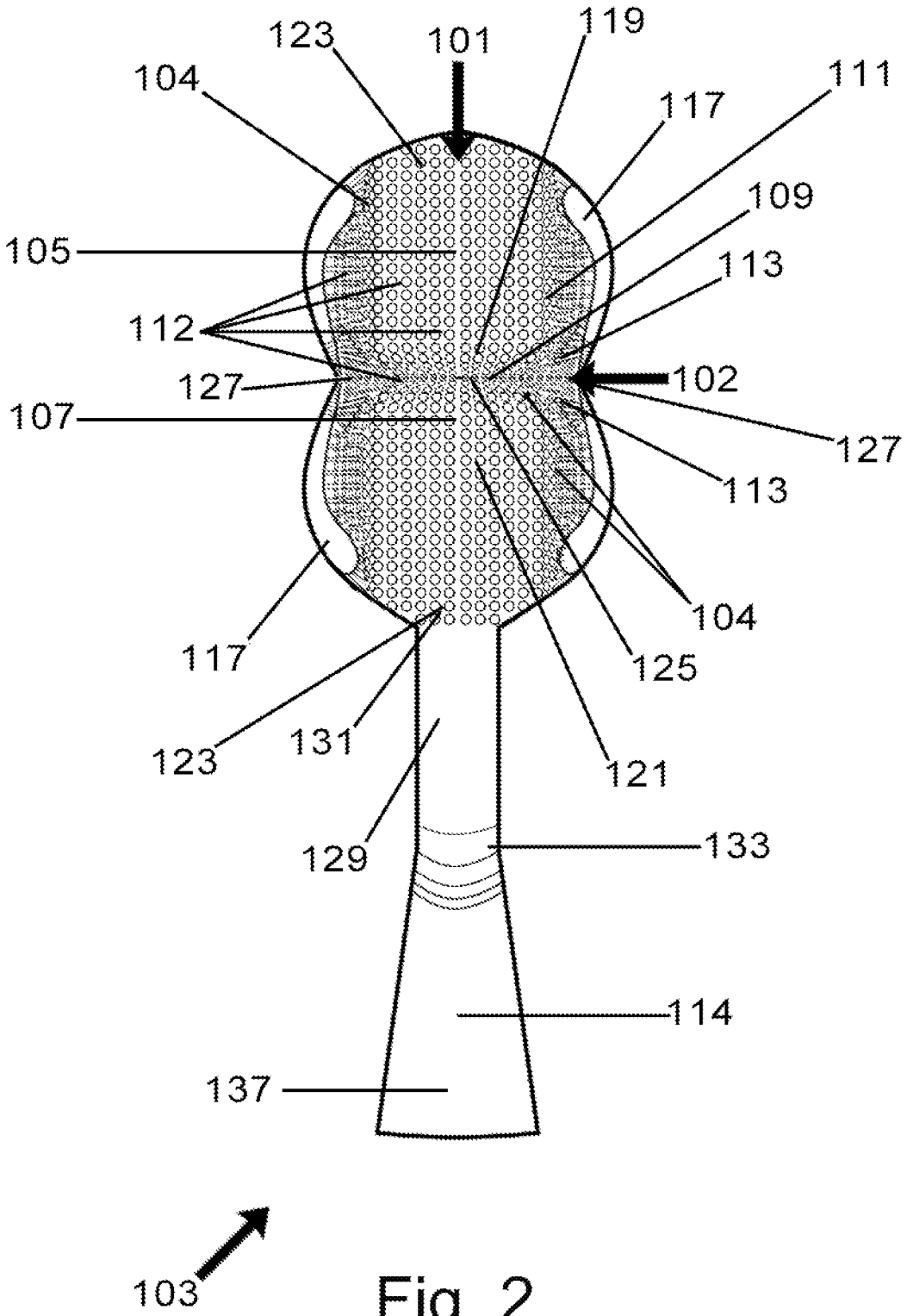
FIG. 2 is a front view of the same tooth- and gum-surrounding brushing head set forth in FIG. 1, enlarged to show more details, in accordance with aspects set forth in this application.

FIG. 1 is a front view of an example electric oral care device 100 with a new form of tooth- and gum-surrounding brushing head 103, along with an example cartridge 106 and cartridge-loading compartment 108, which may be shaped according to a complementary proprietary form factor in some embodiments, and other unique embodiments set forth in the present application. FIG. 2 is a front view of the same tooth- and gum-surrounding brushing head 103 set forth in FIG. 1, enlarged to show more details, in accordance with aspects set forth in this application. In some embodiments, oral care device 101's brushing head, such as the example criss-cross channel format shown as brushing head 103, includes multiple teeth-accepting channel(s), such as teeth-accepting channels 101 and 102, each for accepting one or more teeth in a set of a user's teeth. In the example pictured, teeth-accepting channel 101 is shaped to accept two (2) of a user's teeth at once, each in example teeth-accepting pockets 105 and 107. Similarly, in the example pictured, teeth-accepting channel 102 is configured to accept one or more teeth of a set of a user's teeth at once, within a teeth-accepting pocket(s) 109. In some embodiments, any or all of teeth-accepting pockets 105, 107 and/or 109 may be sized to accept one (1) of a user's teeth simultaneously. In some embodiments, any or all of teeth-accepting pockets 105, 107 and/or 109 may be sized to accept two (2) of a user's teeth simultaneously. In some embodiments, any or all of teeth-accepting pockets 105, 107 and/or 109 may be sized to accept three (3) of a user's teeth simultaneously. In some embodiments, any or all of teeth-accepting pockets 105, 107 and/or 109 may be sized to accept four (4) of a user's teeth simultaneously, and so on. In some embodiments, teeth-accepting pockets 105 and 107 may be sized to accept two (2) of a user's teeth at once, while teeth-accepting pocket 109 may be sized to accept one (1) of a user's teeth simultaneously.

However, as discussed in greater detail below, in some embodiments, teeth-accepting channel 101, and teeth-accepting pockets 105 and 107 comprised within it, are preferably wider horizontally (in a direction perpendicular to the length of teeth-accepting channel 101) than teeth-accepting channel 102 and teeth-accepting pocket(s) 109 is in a direction perpendicular to the length of teeth-accepting channel 102. As discussed in greater detail below, this greater width allows teeth-accepting channel 101 to accept, clean and treat a user's wider teeth, such as her or his molars, while the thinner teeth-accepting channel 102, allows a user to insert her or his narrower teeth, such as her or his incisors, and clean and treat those teeth with teeth-accepting channel 102.

To form tooth-accepting pockets 105, 107 and 109, teeth-cleaning brush(es), such as the example pictured as teeth-cleaning brush(es) 111 are provided, comprised within tooth-accepting pockets 105, 107 and 109, and may include complex, tooth-surrounding, curved surfaces, such as the examples shown as curved surfaces 104, in some embodiments, which may be formed, at least in part, by the heads of bristles, such as example bristles 112. In some embodiments, those curved surfaces, such as the example shown as example curved surfaces 104, are curved to conform to, match and/or hug the outer surface curves of a user's teeth, gums and gumline, and, in some embodiments, to penetrate between teeth (cleaning the interdental spaces between teeth) and the teeth and gumline. For example, in some embodiments, some of bristles 112 form interdental-penetrating brushes, such as example interdental-penetrating brushes 113. In some embodiments, the contours of the outer surface of tooth-accepting pockets 105 and 107 may be created to match a three-dimensional ("3D") image, mold, or other data regarding a particular user's teeth, or an average 3D shape of an average tooth within a set and/or subset of teeth of that particular user.

Thus, in accordance with some embodiments of the invention, a user may insert her or his teeth, one each, into tooth-accepting pockets 105 and 107, and then activate a motor or other actuator(s) connected with and actuating brushing head 103 (e.g., by driving it with sonic and/or ultrasonic vibrations or other oscillations) to begin using oral care device 100 to clean and/or treat her or his teeth. In some such embodiments, a user may also introduce toothpaste, or another form of dentifrice, into any or all of channels (e.g., by expelling it into the channel(s) with a toothpaste tube and nozzle (not pictured). In some embodiments, such introduction of a dentifrice may be automatically delivered (e.g., through internal tubes with ports exiting into the channels) through a neck 114 and pumped from a reservoir within main body 115 and/or cartridge 106 of electric oral care device 100. In some embodiments, and as provided for other oral care devices in the present application, the control system may sense (e.g., with touch or other pressure sensors connected to bristles 112, or a camera or other optical or radiation sensor mounted on brushing head 103) whether a user has properly so inserted the appropriate number of teeth (e.g., one each), into channels 101 or 102, or tooth-accepting pockets 105 and 107, or 109, and may, in some such embodiments, only perform certain actions (e.g., actuating teeth-cleaning brushes 111), or actuation modes, when the user's teeth are so properly inserted (e.g., each tooth centered on and seated within each of tooth-accepting pockets 105 and 107, or teeth-accepting pocket 109). Also as with other oral care devices set forth in the present application, in some embodiments, the teeth-cleaning brushes 111 may be control system-actuable in some embodiments, and each of teeth-cleaning brushes 111 may be powered and controlled by a control system at least partially within oral care device 100.

As mentioned above, curved surfaces 104 may form teeth-accepting pockets, such as teeth-accepting pockets 105, 107 and 109. It bears repeating, however, that the recitation of particular orders and numbers of features, such as one (1), two (2), three (3) or some other number of channels, and tooth-accepting pockets, and mouthpieces, with respect to any oral care device set forth in this application, is illustrative of some embodiments only, and is not in any way limiting as to the scope of the invention.

In any event, if multiple tooth-accepting pockets are provided, as in the example embodiment pictured, interdental cleaning devices may also be provided, in some embodiments. As mentioned elsewhere in this application, such interdental cleaning devices include interdental space penetrating brushes (such as the example interdental penetrating brushes 113). In some embodiments, such interdental cleaning devices may comprise, or be comprised within, flossing lines or fluid-directing devices, such as with fluid-releasing port(s) mounted on the flexible, semi-compliant bristle-mounting walls, such as the examples shown as bristle-mounting bumpers 117. In some embodiments, such fluid-releasing port(s) may also introduce dentifrice, treatments, water and/or other fluids into teeth-accepting channels, and onto bristles 112. In some embodiments, such fluid-releasing port(s) may be fluid-ejecting jets, releasing pressurized, or otherwise conditioned streams of fluid (e.g., using an actuator, which may be a motor or an ultrasound actuator, in some embodiments.) In some embodiments, curved surfaces 104, and/or bristles 112, may also form cleaning features, such as example dental cleaning ridge 119. In some embodiments, the angle of bristles 112 may be continuously variable, along the curved surfaces of 104. In some such embodiments, the angle of bristles 112 is so continuously variable to result in closely-matching the surface of a user's teeth and gums when his or her teeth are properly inserted within the teeth-accepting pockets. For example, in some such embodiments, the angle of bristles 112 is so continuously variable according to a function to cause the center tips of each of bristles 112 to tangentially-touch the user's teeth and/or gums when his or her teeth are properly inserted within the tooth-accepting pockets, or approximately so.

In some embodiments, teeth-accepting channel 101 includes an open-ended, relatively flat trench 121, with flat open entrances 123, at each end of the channel. Such an open, flat trench allows fore and aft movement of oral care device against the surfaces of a user's teeth inserted within channel 101, while keeping a line of a set of the user's teeth inserted into the teeth-accepting channel 101, to aid in manually scrubbing the user's teeth and gums, in some embodiments. And, in some embodiments, this feature allows a user to quickly reposition teeth accepting channel 101, and pockets 105 and 107, over a different set of teeth. Similarly, in some embodiments, teeth-accepting channel 102 also includes an open-ended, rounded trench 125, with rounded open entrances 127, at each end of the channel. As with channel 101, such an open, flat trench allows for movement in both directions of the length of the channel, and movement of bristles within channel 102 against the surfaces of a user's teeth inserted within the channel, while keeping a line of a set of the user's teeth inserted into the teeth-accepting channel 102, to aid in manually scrubbing the user's teeth and gums, in some embodiments. And, in some embodiments, this feature allows a user to quickly reposition teeth-accepting channel 102, and pocket(s) 109, over a set of teeth (e.g., a user's incisors, when brushing head 103 and channel 102 becomes proximate to them).

In some embodiments, the electric oral care device 100 may provide haptic feedback to the user when she or he has properly inserted two of her teeth into tooth-accepting pockets 105 and 107, one each, centered and seated. For example, in some embodiments, a control system comprised within electric oral care device 100 issues a distinct vibration to the user, or pattern of vibrations, through a motor or other actuator of electric oral care device 100, to indicate that the teeth inserted into tooth-accepting pockets 105 and 107 have been properly inserted, and another distinct vibration or pattern of vibrations, when the user's teeth have been adequately cleaned or otherwise treated, and it is time to move oral care device over to a new set of teeth, inserting them into tooth-accepting pockets 105, 107 and/or 109. Similarly, in some embodiments, the electric oral care device 100 may provide haptic feedback to the user when she or he has properly inserted two of her teeth into tooth-accepting pocket(s) 109, and such teeth are properly positioned (e.g., by sensors attached to bristles within rounded, incisor tip-hugging trench 125, detecting the associated pressure for properly inserted teeth). Also similarly, the control system may create another distinct vibration or pattern of vibrations, when the user's teeth inserted have been adequately cleaned or otherwise treated by channel 109 and trench 125, and it is time to move oral care device over to a new set of teeth, inserting them into tooth-accepting pockets 105, 107 and/or 109. In some embodiments, upon sensing whether particular teeth are present within any of tooth-accepting pockets 105, 107 and/or 109, of the teeth-accepting channels (e.g., through connected sensors), a control system within oral care device 100 records data related to the amount of time each such tooth has been cleaned, and allows a user to access records related to those data. In some such embodiments, the control system determines whether a minimum amount of brushing, cleansing or treatment of each tooth, and/or each tooth surface, has occurred (e.g., using connected camera's monitoring soil or brushing and treatment actions for each tooth surface it observes), and records and reports data related to those activities to a user. In some embodiments, the control system may alert the user when removing a tooth from a tooth-accepting channel and inadequate brushing time, soil removal and/or other indicators of insufficient cleaning or treatment have yet occurred for that tooth. In some embodiments, haptic feedback may indicate a direction of a tooth remaining to be so cleaned or treated, by vibrating on an area of the brushing head closes to the insufficiently cleaned or treated tooth during brushing. In some embodiments, the control system issues awards, such as praise (e.g., a green light, sonic chime, or multiple haptic throbs), when the user responds to such haptic feedback with actions completing such adequate cleaning and/or treatment. To aid in such directional indications, of teeth in need of sufficient cleansing and/or treatment, the control system may be connected with, power and control a number of haptic feedback actuators, located at different positions at or about all sides of the brushing head. Thus, by individually actuating each such actuator, the control system can indicate a direction of such insufficiently cleaned or treated teeth (or, in some embodiments, gums and other parts of the user's mouth.) In order to determine the location of a user's teeth, and track their location, to facilitate such directional features, the control system may observe (e.g., via cameras or other sensors on or about teeth-accepting channels) identifying characteristics of each of a user's tooth, and associating data related to those characteristics with observed times and other aspects of cleaning and treatment of each teeth, as well as observing and recording data concerning the location (e.g. spatial relationships) between each of a user's teeth, and other features of her or his oral cavity, in various embodiments.

To ease seating of oral care device 100 on a user's teeth, in some embodiments, an elongated flat section 129 of neck 114 of brushing head 103 may be included. In some such embodiments, such an extended flat section 129 may abut the proximal flat open entrance 131, of teeth-accepting channel 1501.

In some embodiments, to aid in maintaining the correct angle of engagement of brushing head 103, while sliding teeth through channel 101 or 102, a swiveling joint 133 may be provided. In some such embodiments, swiveling joint 133 may be an omni-directional swivel. In some embodiments, swiveling joint 133 may be a force-biased swivel, which force-bias forces the return of swiveling joint 133 to a straightened position, as pictured, in the absence of external forces on swiveling joint 133.

As with other oral care devices set forth in the present application, a series of user controls and feedback devices may also be included, in some embodiments, which are connected to a control system within (not pictured), or connected to, oral care device 100. As mentioned above, such a control system may be connected with, and able to issue operational commands to, any and all actuators, displays and sensors set forth in reference to the present figure, or elsewhere in the present application. For example, motors, ultrasonic emitters, jets, pumps, or other actuators, such as linear actuator 135, which may be attached to a brushing head-insertable and -fastening drive shaft 137, may be provided within handle section 155, in some embodiments. In some embodiments, ultrasonic emitters or other actuators may be provided within brushing head 103, or cartridge section 106, of oral care device 100.

In some such embodiments, a light indicator display 139 may be provided, and used to indicate particular statuses relevant to the operation of oral care device 100, such as whether device 100 has been powered up. In some embodiments, a more complex graphical display, such as example graphical display 141, may instead, or in addition, be used. In some embodiments, graphical display 141 may provide a readout indicating a duration of use, intensity and/or a mode of operation, as discussed elsewhere for displays of oral care devices in the present application, and as pictured. For example, in the embodiment pictured, a readout of an Anti-Cavity mode is indicated by an abbreviation "Anti-Cav" appearing within graphical display 141, indicating to a user that the oral care device is presently being operated in a mode to encourage the prevention of cavity formation for a user's teeth. For example, in some such embodiments, more fluoride may be introduced into the teeth-accepting channels of brushing head 103, than in other modes, and for a longer duration, with more vigorous oscillations (brushing) linear actuator 135 and brushing head 103 to which it is attached, than in other modes of operation. In some embodiments, a multivariate, touch-actuable, lighted display may be included, such as the example pictured as touch-actuable lighted array display 143. In some such embodiments, a user may select, and visualize, different parameters of operation of oral care device 100, for example by touching any surface area of touch-actuable lighted array display 143, actuating any of its actuable pixels, such as the pixels shown as 145, causing them to be illuminated and to select a corresponding mode of operation, duration, intensity level, or any other variable parameter of operation. In some embodiments, the higher up the pixels selected, the greater the intensity level of operation indicated and carried out by the oral care device when operated. In some embodiments, the wider the selection of pixels laterally, on either side of touch-actuable lighted array display 143, the greater the duration, or the greater degree of some mode of operation, is selected and indicated.

As with other oral care devices set forth in this application, in some embodiments, a user may select or request a mode of operation of oral care device 100 with a mode selection button, such as either of thumb- or finger-actuated mode selection buttons 147 or 149. In some embodiments, such thumb- or finger-actuated buttons may be provided within thumb- or finger-grip depressions, such as the examples pictured as 151. In some embodiments, thumb-grip depressions may comprise biometric or other sensors, to identify the particular user and/or determine whether a user is properly gripping a handle section 155 of oral care device 100. In some embodiments, any selections or user-commands required for any mode, intensity or other aspect of the invention may be provided through such user controls.

In some embodiments, oral care devices in accordance with aspects of the present invention may hold and distribute water, dentifrice, treatments, and other oral care materials from standardized packages, which may be temporarily, reversibly connected to fluid conduits of the oral care devices, to at least part of a user's oral cavity, such as her or his teeth, gums, tongue, sublingual areas, the roof of the mouth, and throat. In some embodiments, such standardized packages may be issued and delivered from a remote source, which may be controlled, at least in part, by a control system and/or a medical authority, such as a dentist. For example, and also as mentioned above, in some embodiments, specialized, standardized cartridges, such as example cartridge 106, may be so issued. In some embodiments, such standardized packages (e.g., cartridge 106) may include one or more part(s) with a proprietary format, to ensure that only correct cartridges, approved for use with the particular type of oral care device, are installed onto or into the oral care device. For example, cartridge 106 is pictured with an unusually-shaped housing 157, shaped according to a proprietary, unusual form factor—namely, in this example, a generally conical shape of particular proportions, angles and dimensions, with a long tab. As a result, a lateral sliding tab 159 conforms with that proprietary, unusual form factor. Similarly, a cartridge-loading compartment 108 is also shaped according to the same, proprietary, unusual form factor, albeit in reverse (shaped as a mold impression) to the shape of cartridge 106, such that cartridge-loading compartment 108 and cartridge 106 have a complementary, inverse 3-D form factor relative to one another. As such, and as pictured, cartridge 106 may be installed into compartment 108 by sliding end 161 of cartridge 106 upward, into cartridge-loading compartment 108. In some embodiments, cartridge 106 and oral care device 100 may include some connectors, which may be conduits from an internal tank holding such oral care fluids within cartridge 106, which deliver fluids to a user's teeth and oral cavity. For example, in some embodiments, such conduits within oral care device 100 connect with ports delivering fluids from cartridge 106 to teeth-accepting channel(s) of brushing head 103. In some embodiments, such conduits within oral care device 100 and such conduits from an internal tank of cartridge 106 may comprise connecting ports, with a complementary form factor for physically interfacing with one another. In some embodiments, such ports include valves which are forced open upon such physical interfacing. In some embodiments, such valves electrical actuators, which are controlled by a control system, which may be present within cartridge 106 and/or oral care device 100. For example, in some such embodiments, such a control system may be a control system such as that disclosed in reference to FIG. 13, below. In some embodiments, multiple such internal tanks may be present in cartridge 106. In some embodiments, such an internal tank may be present within oral care device 100. In some such embodiments, of course, cartridges such as 106 may be omitted, and just such on-board tanks within oral care device 100, or another source (e.g., external, with a service hose connected to oral care device 100), may, instead, be used. In some such embodiments, such an internal tank may be present within oral care device 100 and may receive cleaning and treatment fluids from cartridge 106, which may then be decoupled from oral care device 100 prior to use.

Similarly, and as with other oral care devices set forth in this application, customized brushing heads or liners with custom-shaped brushes may be ordered and issued, separately from the remainder of oral care device 100, in some embodiments. In some such embodiments, such customized liners, brushes and/or brushing heads may be optimized for particular modes of operation, or for the cleaning or other treatment needs of a particular user (e.g., sized and shaped based on a 3D image or mold or other data related to a user's teeth and/or mouth shape).

In some embodiments, as with other oral care devices discussed in this application, observations may be made by the control system of oral care device 100, or user operating such a control system, or a control system variably connected with such control system(s). In some such embodiments, sensors are located within brushing head 103, and connected with such a control system. In some such embodiments, such sensors may be a camera. In some such embodiments, such sensors may detect changes in the condition of a user's mouth, at different times, as will be discussed in greater detail below. For example, in some such embodiments, such sensors may detect plaque and/or tooth decay, or any other oral-care relevant conditions, using any technique set forth in the present application for such detection.

Turning back to the enlarged view of tooth- and gum-surrounding brushing head 103 pictured in FIG. 2, details discussed above relating to brushing heads can be seen more clearly. In addition, although 137 is not pictured, because it is a part of the handle section 155 of electric oral care device 100, rather than interchangeable brushing heads such as brushing head 103. However, a tightly-interfacing and fastening receiving section 138, with a complimentary, fastening (and, in some embodiments, interlocking) form factor relative to brushing head-insertable and -fastening drive shaft 137 is pictured. Thus, by inserting brushing head-insertable and -fastening drive shaft 137, as pictured in FIG. 1, into an open entrance of the box-shaped tightly-interfacing and fastening receiving section 138, until its ramped, semi-flexible, elastic, or otherwise inter-locking sides exert a holding force against shaft 137, a user can install an interchangeable brushing head, such as brushing head 103, onto the remainder of electric oral care device 100.

Figure 3:
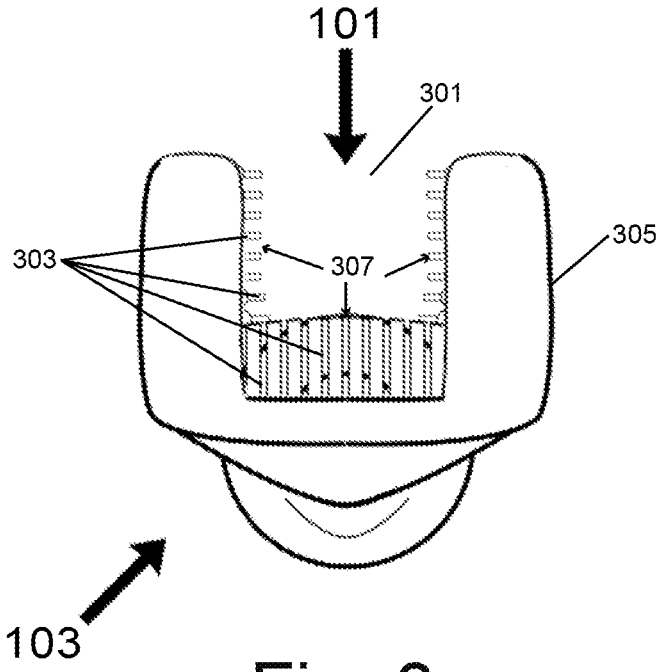
FIG. 3 is a top view of a similar tooth- and gum-surrounding brushing head as that set forth in FIGS. 1 and 2, in accordance with some aspects set forth in this application.

FIG. 3 is a top view (from the distal end) of the same, or, in some embodiments, a similar, tooth- and gum-surrounding brushing head 103 as that set forth in FIGS. 1 and 2. From this new perspective, various aspects of brushing head 103 can be more clearly seen, in some respects. For example, the depth of a teeth-accommodating void 301, of teeth-accepting channel 101, can be more clearly seen in FIG. 3, in accordance with some embodiments. Teeth-accommodating void 301, and teeth-accepting channel 101 generally, are formed by the array of scrubbing bristles, such as those shown as example bristles 303 attached to or integral with an outer body and scaffold 305 of brushing head 103. Bristles 303 have regionally-varying lengths, together creating tooth-interfacing surface contours 307. In some embodiments, tooth-interfacing surface contours 307 hugs and match the outer contour of a user's teeth. In some embodiments, tooth-interfacing surface contour 307 is smaller than the outer contour of a user's teeth, while still having a complimentary shape, conforming to the outer surface of a user's teeth. In some embodiments, such a smaller tooth-interfacing surface contour creates surface pressure upon inserting teeth into void 301. In some embodiments, that surface pressure is controlled. For example, in some such embodiments, outer body and scaffold 305 is semi-compliant and force-biased, creating an at least relatively constant force through an elastic range, as teeth of different sizes are inserted or slid through channel 101 during brushing. As another example, in some embodiments, scaffold 305 and/or bristles 303 may be mounted on elastic and/or actuators that control the pressure of bristles 303 against a user's teeth over time. In some embodiments, any such actuators are controlled by a control system. In some embodiments, bristles 303 and contour 307 are shaped during manufacturing to match and/or interface with a user's teeth. For example, in some such embodiments, the length of each bristle, and the contours they form, are based on dental molds, 3D scans, or other information regarding the size and shape of a user's teeth or other mouth aspects. In some embodiments, the length of each bristle, and the contours they form, are based on such information relative to a class of users with a particular range of shapes and/or range of sizes of teeth (e.g., length/depth of teeth, width of teeth, depth of concavities of teeth, etc.). In some embodiments, the length of each bristle, and the contours they form, are based on average shapes and/or sizes of sets of teeth, which are intended to be inserted by a user or class of users into channel 101.

Figure 4:
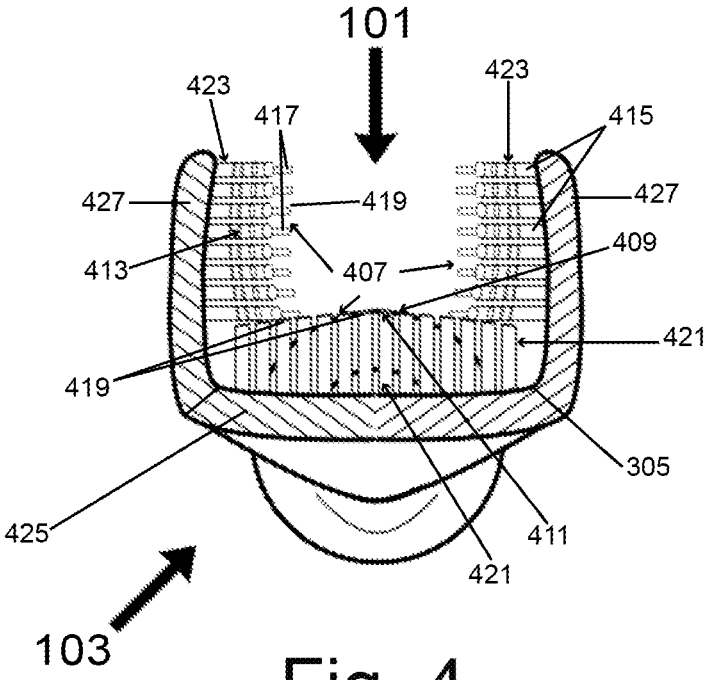
FIG. 4 is a top, cross-section view of the same tooth and gum-surrounding brushing head set forth in FIG. 2, exposing more details of brushes and individual bristles, and other aspects, comprised in the brushing head.

FIG. 4 is a top, cross-section view of the same tooth and gum-surrounding brushing head 103 set forth in FIG. 2, exposing more details of brushes and individual bristles, and other aspects, comprised in the brushing head. From this perspective, some differing individual bristle lengths, and sets of lengths forming tooth-interfacing surface contours, now shown as contours 407, can be more clearly viewed. In some embodiments, at least some of contours 407, such as example distal tooth surface-interfacing contour 409, may include a convex curve. In some such embodiments, such a convex curve may peak at a central, or approximately central, region 411 of channel 101, as pictured. In some embodiments, such a convex curve of a distal tooth surface-interfacing contour 409 and/or region 411, may match the concave surface of the biting surface of a user's tooth to be inserted into channel 101. In some embodiments, at least some of contours 407, such as example side tooth surface-interfacing contour 413, may include a concave curve. In some embodiments, such a convex curve of a distal tooth surface-interfacing contour 409 and/or region 411, may match the convex surface of the side of a user's tooth to be inserted into channel 101.

As can be seen in FIG. 4, some of bristles 303 are provided in shorter sets, such as example low-profile bristles 415, while others, such as higher-profile bristles 417, are provided in progressively longer sets adjacent to bristles 415. Together, these lengths may be selectively and regionally-varied to create a tooth-interfacing curve that produces optimal pressure, and surface angles against a user's teeth, for the distal scrubbing tips 419 of the bristles 303. In general, in some embodiments, all, or substantially all, of bristles 303 are shorter in length than the bristles of most currently-used manual toothbrushes. For example, whereas most manual toothbrushes have a bristle length of between 10 to 13 millimeters ("mm"), depending on the intended user (children through adult) some embodiments of the present invention employ a range of bristle lengths entirely below that range of lengths. In some embodiments, the range of bristle lengths so employed is significantly below the 10 to 13 mm range. For example, in some embodiments, the bristle lengths of bristles 421, which form distal tooth surface-interfacing contour 409, may be between, or approximately between, 2.5 and 5.5 mm. In some embodiments, the bristle lengths of bristles 423, which form side tooth surface-interfacing contours, are of an even shorter range. For example, in some embodiments, the bristle lengths of bristles 423, are between 1 and 3.5 mm. However, in some embodiments, more conventional bristle lengths are used, at least for some of bristles 303. In some embodiments, longer bristle lengths are used in brushing heads that are generalized for use among a range of tooth sizes and users (e.g., Small, Medium and Large size brushing heads for Small, Medium and Large sized users' teeth). In some embodiments, some of bristles 303 are thicker than others of bristles 303. For example, in some embodiments, as pictured, bristles 421 are thicker than at least some of bristles 423. In some embodiments, some of bristles 303 are a different shape than others of bristles 303. For example, in some embodiments, the tips of bristles 421 have more tooth-interfacing edges (e.g., a triangular, square or round cylindrical bristle and tip) than the tips of bristles 423 (e.g., a round cylindrical bristle and tip). In any event, regardless of the cylindrical shape of the bristle, in some embodiments, some bristles have a domed or otherwise curved tip, while others may have a pointed, ridged, or otherwise sharper shaped. For example, in some embodiments, bristles 421 are pointed and/or edged while bristles 423 are domed.

It should be understood that, although bristles 421 are shown as having a vertical, perpendicular mounting angle with scaffold 305, and bristles 423 are shown as having a horizontal, also perpendicular mounting angle to their anchoring point, in some embodiments, the angle of all of bristles 303 are continuously varied to create a tangential, or approximately tangential, contact with the surface of a user's tooth when inserted into channel 101 (initially contacting the tooth at approximately the center of the surface of the tip of each bristle).

As also can be seen in more detail in the present figure, in some embodiments, scaffold 305 may be formed as a single, unified piece of hard or plastic material. In some embodiments, however, scaffold 305 may be formed of a lower platform section 425, in which lower bristles 421 are directly anchored, and upper side bumper sections 427, in which side bristles 423 are anchored. In some embodiments, side bumper sections 427 may be formed of a softer (e.g., rubber or foam rubber) material, and may be more flexible and compliant than the material(s) comprised in lower platform section 425. In some embodiments, discussed in greater detail below, side bumper sections such as side bumper sections 427 may constitute or include a leaf spring mechanism, allowing for a relatively constant bristle pressure as teeth inserted in channel 101 move lengthwise through channel 101 during brushing. Such brushing techniques, and others, are discussed in greater detail below.

Figure 5:
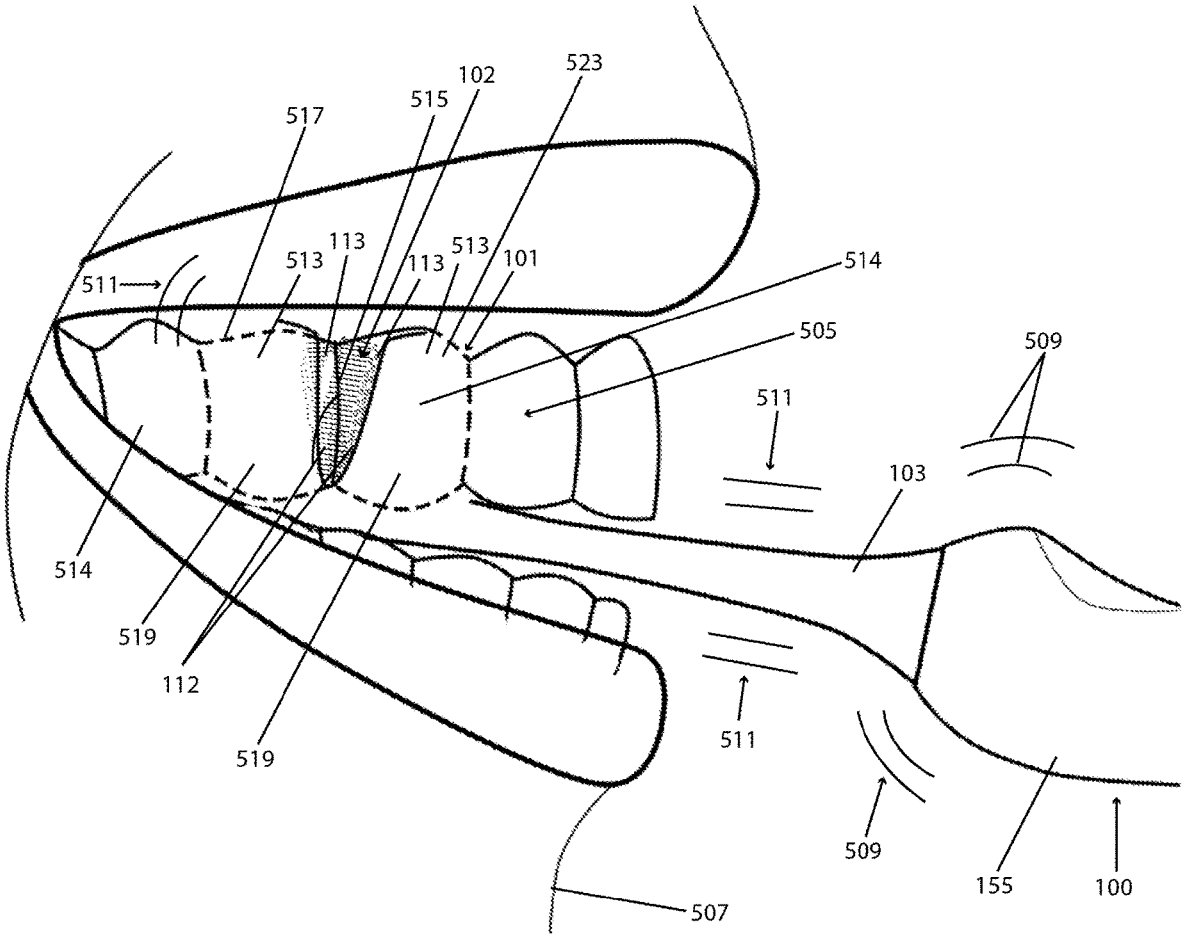
FIG. 5 is a side view of the same electric oral care device, as set forth in FIG. 1, and brushing head set forth, for example, in FIGS. 3 and 4, illustrating their use cleaning an example row of teeth of a user.

FIG. 5 is a side view of the same electric oral care device 100, as set forth in FIG. 1, and brushing head 103 set forth, for example, in FIGS. 3 and 4, illustrating their use cleaning and/or treating an example row of teeth 505 of a user 507. As shown by vibration- and/or oscillation-indicating lines 509, electric oral care device 100 is shown as currently "activated," meaning that one or more internal actuators (e.g., an oscillating linear or other actuator) is currently driving brushing head 103, as shown by vibration- and/or oscillation-indicating lines 511. As also shown in the present figure, user 507 has inserted some of her teeth—namely, two teeth 513 of example row of teeth 505—into channel 101 of brushing head 103. As a result, vibrations and/or oscillations of brushing head 103 cause bristles of brushing head 103, such as example bristles 112 of brushes 113 to scrub and/or treat (depending on the nature of the oscillations, and the use mode of electric oral care device 100, and the type of dentifrice or other treatment put in channel 101 by the user) the surfaces, such as example surfaces 514, of row of teeth 505. Furthermore, due to the tooth- and gumline-surrounding and -penetrating 3D profile of channel 101, user 507 is simultaneously so scrubbing and/or treating the entire outer surface of the teeth she has inserted into channel 101, including the interdental space 515, and her adjacent gumline 517.

As mentioned above, in some embodiments, electric oral care device 100 includes modes of operation in which it provides haptic or other feedback to the user and, in some such embodiments, electric oral care device 100 provides such feedback when it detects (e.g., via pressure sensors and/or other sensors such as an inward-facing camera within channel 101, in some embodiments) that a set of teeth are centered within teeth-accepting pockets 519 formed by the bristles 112 (a.k.a. "properly positioned" her teeth for cleaning and/or treatment), as pictured. In addition, and also as discussed elsewhere in this application, in some embodiments, electric oral care device 100 provides haptic or other feedback to the user (e.g., a chime) when the user has adequately scrubbed and/or treated the teeth presently inserted into channel 101. In some such embodiments, electric oral care device 100 determines that the user has adequately scrubbed and/or treated the teeth presently inserted into channel 101 by detecting a clean surface of those teeth (e.g., with a camera or other sensor, and/or, e.g., with a decreased resistance to movement by bristles 112 which may be determined by a power, resistance or voltage meter sensor and/or a physical movement sensor, within electric oral care device 100, in some embodiments. In some methods in accordance with aspects set forth in this application, the user then responds by moving electric oral care device 100 forward (to the right, in the perspective of the figure) to insert another tooth into channel 101. It should be noted that, although brushing head 103 is pictured as enveloping, scrubbing and/or treating two example middle teeth, namely, two teeth 513 of row of teeth 505, this example is for illustrative purposes only. In some embodiments, a user inserts any of her teeth, as convenient and/or in need of cleansing and/or treatment, and then activates electric oral care device 100, and then progressively pulls or pushes brushing head 103 fore and/or aft (left and/or right) to clean additional teeth (a.k.a. "transitioning" brushing head 103 to additional teeth). In some embodiments, the user so progressively pulls or pushes brushing head 103 while keeping teeth (or at least one tooth) inserted within teeth-accepting channel 101. In some embodiments, this may be accomplished even when a user is transitioning brushing head 103 to additional teeth and inserting them into a different teeth-accepting channel (e.g., teeth-accepting channel 102) of brushing head 103. Such an embodiment is set forth in greater detail below, in reference to FIG. 6, below. In any event, in some embodiments, a user begins scrubbing and/or treating all of her teeth by filling teeth-accepting channels 101 and 102 with dentifrice or another form of cleanser or treatment, and, in some embodiments, some water, and then inserting her back-most teeth (e.g., wisdom teeth or rear molars, as applicable) that fit simultaneously into teeth-accepting channel 101, into teeth-accepting channel 101. Following the adequate cleansing and/or treatment of those teeth, which may, as discussed above, be indicated by feedback issued by the control system, she then transitions brushing head 103 to the next-forward tooth or set of teeth that fit simultaneously and properly within teeth-accepting channel 101. In some embodiments, the user continues so transitioning brushing head forward (toward the right-hand side, in the perspective of the figure) until all of her molars and pre-molars are so cleaned and/or treated within channel 101. In some embodiments, the user may transition channel 101 to one or more canine teeth, such as example canine tooth 523, cleansing them within channel 101 as well, as pictured.

In some embodiments, a user may clean all of her teeth, including the incisors, such as example incisors 601, within channel 101, by swiveling handle section 155 to the side, and altering the angle of brushing head 103 to a perpendicular position to that pictured, and transitioning channel 101 over the incisors. In some such embodiments, teeth-accepting channel 102 may be omitted. However, in some embodiments, as discussed below, the user next transitions brushing head 103 to the incisors by then inserting her incisors into teeth-accepting channel 102. In some embodiments, all of the necessary transitions described above, from tooth to tooth, of a top or bottom set of a user's teeth, may be carried out in one continuous movement, as will be discussed in greater detail below.

Figure 6:
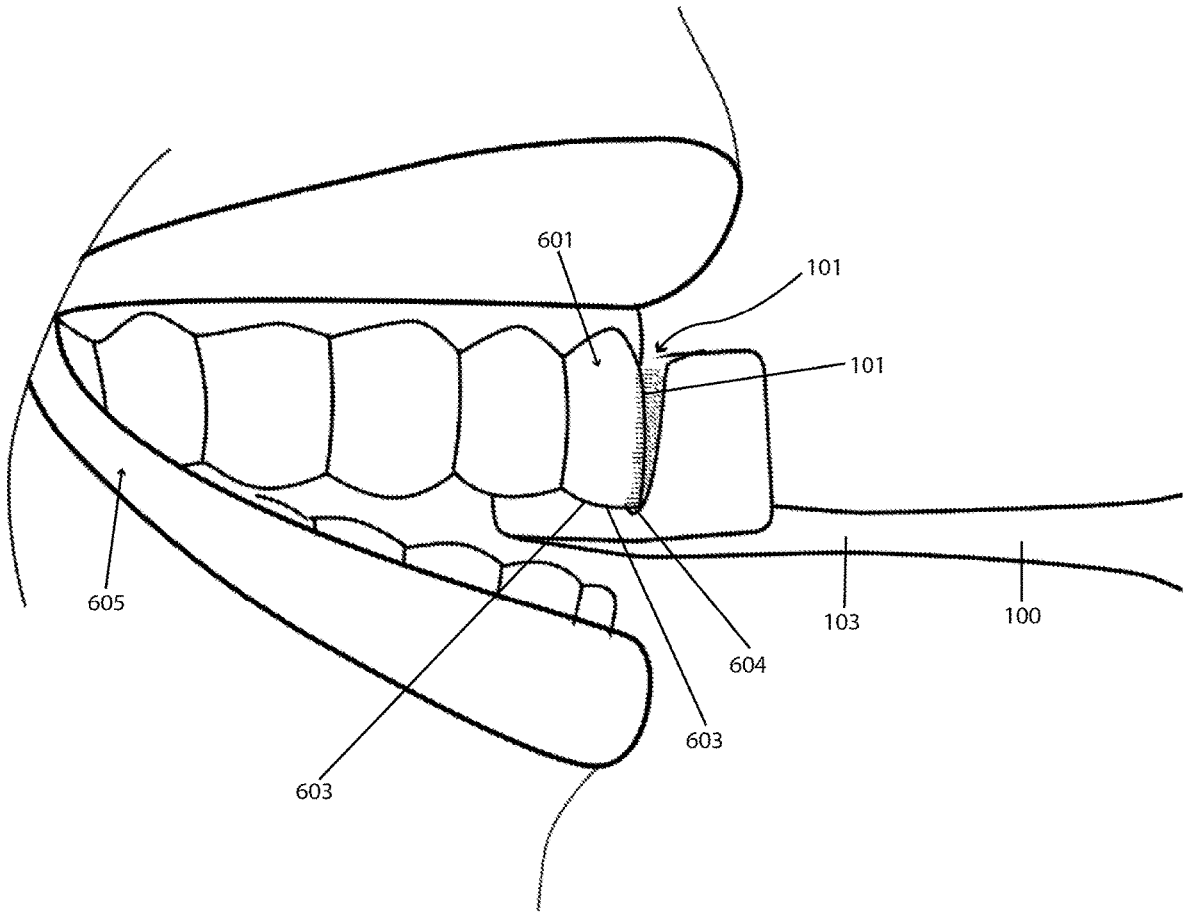
FIG. 6 is a side view of the same electric oral care device and brushing head, as set forth in FIG. 5, illustrating their use after transitioning to clean a new example row of teeth of the user.

FIG. 6 is a side view of the same electric oral care device 100 and brushing head 103, as set forth in FIG. 5, illustrating their use after user 507 has transitioned brushing head 103 to clean a new example row of teeth of the user, namely, example top row of incisors 601. Similarly to teeth-accepting channel 101, user 507 preferably fully inserts her teeth (now, incisors 601) into teeth-accepting channel 102 to cleanse and/or treat them. As used in this application, "fully insert" means placing teeth deeply enough into a teeth-accepting channel that the bottom (biting) surfaces of the teeth contact the bottom surface of the teeth-accepting channel. In the instance pictured, user 507 has so fully inserted some of her incisors 601 into teeth-accepting channel 102, because the bottom edges 603 of incisors 601 have contacted the rounded (or otherwise curved) bottom 604 of teeth-accepting channel 102. Also as with teeth-accepting channel 101, in some embodiments, teeth-accepting channel 102 comprises one or more tooth-accepting pockets, with surface curves defined by the length of bristles within and/or adjacent to, teeth-accepting channel 102. Thus, as with teeth-accepting channel 101, such bristles may be attached to pressure sensors, or other sensors may be present, within or connected to a control system within electric oral care device 100, which may alert a user when teeth properly inserted within channel 102 have been adequately cleansed and/or treated (as the case may be) indicating to the user that she should proceed, transitioning to the next tooth or teeth that may simultaneously fit within teeth-accepting channel 102. Unlike with the use of teeth-accepting channel 101, the user so transitions brushing head 103 by moving brushing head laterally (into, or out of the page, in the perspective of the figure) toward the side of her mouth, such as right side of her mouth 605. However, while cleaning her side-most incisors, brushing head 103 will move fore and aft to some degree and, once all of her incisors have been cleansed and/or treated, from one side of her mouth to the other, brushing head will be positioned to transition rapidly transition to once again cleanse canines, pre-molars and molars, in teeth-accepting channel 101 (this time, on the other side of the user's mouth). However, in some embodiments, the user may effectively cleanse her canine teeth (or even her molars) by transitioning teeth-accepting channel to those teeth, and swiveling teeth-accepting channel 102 in-line with them, as discussed above for teeth-accepting channel 101.

After completing the cleansing and/or treatment of all of her top set of teeth, user 507 may invert brushing head 103, and follow the same process set forth above, for cleansing her bottom row of teeth. In some embodiments, however, another form of brushing head may be formed by two conjoined brushing heads, so inverted relative to one another, with which a user may simultaneously cleanse and/or treat both upper and lower teeth, adjacent to one another. Thus, in some such embodiments, a user may cleanse all of her teeth (upper and lower) in one continuous movement.

It is important to note that, although the example of a linear, stick-type electric oral care device and brushing head is shown in FIGS. 1 through 6, any of the techniques set forth in this application related to oral care may be practiced, instead or in addition, with any other form of oral care device, including U-shaped or otherwise curved oral care devices and brushing heads, rather than brushing heads with straight teeth-accepting channels, in some embodiments. Similarly, although the examples of an electric toothbrush operating with an actuator producing brush oscillations in the sonic or ultrasonic range are provided, any of the devices, methods, systems and techniques set forth herein may be implemented in other types of oral care devices, including but not limited to, manual brushes and powered oral care devices comprising other types of power sources.

As mentioned above, oral care device 100 may comprise, or be comprised within, computer hardware, such as the example computer hardware set forth below as control system 1300, in FIG. 13. For example, in some embodiments, a user may use or interact with another form of personal electronics comprising and/or comprised within such a control system, such as a personal digital assistant device ("PDA"), and/or external peripheral devices (e.g., a wall-, ceiling- or otherwise environmentally-mounted display device, and/or any number of ambient intelligence, augmented reality, mixed reality and/or display devices), any of which may carry out each of the techniques set forth herein with respect to actuating, controlling and monitoring the operation of an oral care device, and a user's use thereof, and data related to that use.

Regardless of the form of computing and oral care device used, in some embodiments, the computer hardware and software of the control system may create a user interface, such the example graphical user interface ("GUI") shown as handle section 155, comprising visual display(s) and control(s). In some embodiments, such as that pictured, such a user interface 103 is included and presented on a graphical display, such as example smartphone display (not pictured).

Figure 7:
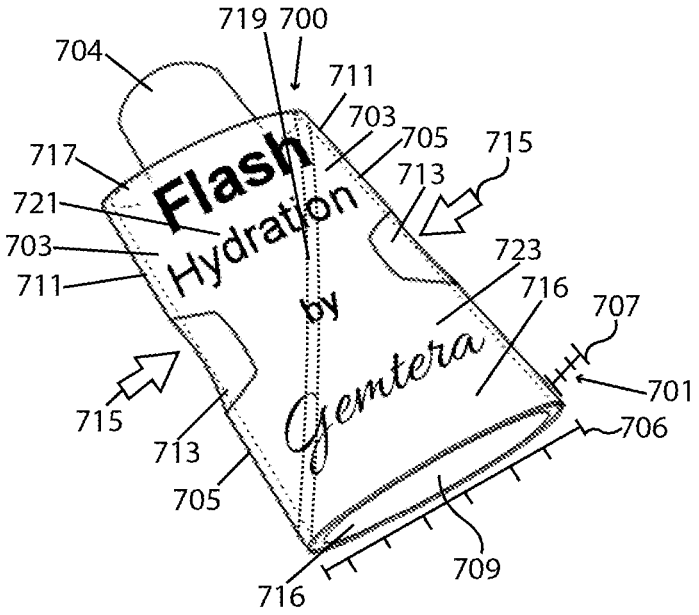
FIG. 7 is a perspective view of a new form of transformable personal care fluid container, in a reduced-profile state, in accordance with aspects of the present invention.

FIG. 7 is a perspective view of a new form of transformable personal care fluid container 700, in a reduced-profile state 701, in accordance with aspects of the present invention. As with other personal care fluid containers, in some embodiments, personal care fluid container 700 includes an internal cavity 703, which may be filled with a personal care fluid. Also as with other personal care fluid containers, personal care fluid container 700 may be opened and closed with a bottle cap or other sealing device 704 (e.g., with threading complementary to a bottle neck, interfaced within it), in some embodiments, which variably opens and closes the internal cavity 703. In some embodiments, internal cavity 703 may be filled with any suitable fluid and/or solid suitable for use in personal care by a user. For example, in various embodiments, a manufacturer may fill cavity 703 with any or all of the following, in any number, type or combination, among any other suitable aspects of a personal care formulation: a lotion, a moisturizer, a humectant, a cream, a butter, a soap, a liquid soap, a hand soap, a body wash, a shampoo, a gel, a conditioner, a mask, a skin brightener, a skin softener, body glitter, a depilatory, a lipstick, a lip gloss, nail polish, a tanning agent, a rouge, makeup, a foundation, a wax, a sunscreen, a sunblock, an essential oil or other oil, a surfactant, an astringent, an antiseptic, a salve, a medicament or other treatment, a deodorant, an anti-perspirant, a cosmetic, a soap, a cleanser, an emollient, an anti-inflammatory, an emulsifier, an exfoliant, a natural ingredient, a botanical, a tea, a spice, an herb, a salt, a vitamin, a perfume, a scent, a terpene, a gel, a pomade, a lubricant, a powder, a dentifrice, toothpaste, water, glycerin, an acid, an anti-oxidant, a flavonoid, a phenol, a stilbene, a phenolic, a mineral, a clay, charcoal or activated charcoal, an alcohol, an ester, a protein, an amino acid, a solution, or a reagent. In some embodiments, cavity 703 may also contain a preservative, chelating agent, stabilizer or other ingredient that enhances the freshness, purity or stability of other ingredients within cavity 703.

In some embodiments, reduced-profile state 701 has a generally flattened structure, in the general form of a box shape with rounded lengthwise edges 705, as pictured with a width, as shown by example adjacent width ruler 706, which is far greater than its depth, as shown by example depth ruler 707 adjacent to generally flat bottom 709. However, it should be understood that, according to some embodiments, any number of alternative, generally flattened or reduced-depth shapes may, alternatively, be used while carrying out aspects of the invention set forth herein, and the exact shape shown is exemplary, only, of those virtually unlimited options that are within the scope of the invention. For example, in some embodiments, rounded lengthwise edges 705 may instead be flat edges, forming a more conventional, squared-off box-like structure.

In some embodiments, rounded lengthwise edges 705 each include a stiff side structure, such as the example stiff internal rods 711, shown in the figure. In some such embodiments, stiff internal rods 711 are attached to two outer finger grips 713, aiding and encouraging a user to press inward against them, completely altering the lateral 3D shape of personal care fluid container 700 (with the exception of the shape of the cap 704 and the overall height of personal care fluid container 700, as shown in the following figure) in the directions indicated by inward pressure vector arrows 715. As a user so exerts inward pressure, rods 711 travel inwards and, causing other more flexible materials 716 within the housing 717 to bend outward, increasing the overall depth of housing 717 and personal care fluid container 700, until stopping at a more rounded, generally cylindrical, or otherwise bottle-like shape, as shown in the following figure.

In some embodiments, rods 711 are not rods, but a more continuous stiff structure that extends, and tapers off into flexible housing material to which it is attached (or with which it is blended or integral). In this way, the resistance of the continuous stiff structure is balanced and distributed to lead to the generally cylindrical, or otherwise bottle-like shape, discussed with reference to the following figure.

In some embodiments, internal cavity 703 may be separated into sections by a frangible internal wall 719. In some embodiments, frangible internal wall 719 is of a sealing material, which, in the flattened state set forth in FIG. 7, effectively separates ingredients within one thus separated upper section 721 of internal cavity 703, from another thus separated lower section 723, with other, separate ingredients. However, when a user presses outer finger grips 713 inward, applying inward pressure as discussed above, and altering the lateral 3D shape of personal care fluid container 700 to the more rounded, deeper shape shown in FIG. 8, frangible internal wall 719 breaks apart, allowing the mixing of different ingredients from separated section 721 and separated section 723, throughout the entire, then-unified internal cavity 703.

In some embodiments, prior to so breaking internal wall 719, the ingredients or other components in upper section 721 are denser than ingredients set forth in lower section 723. Also in some embodiments, prior to so breaking internal wall 719, ingredients in upper section 721 flow more freely than ingredients in lower section 723. In some embodiments, if any solid ingredients are used, they are present in lower section 723. However, in some embodiments, the opposite configuration to any of the configurations set forth herein are used, as well (e.g., a solid powder) in upper section 721.

Figure 8:
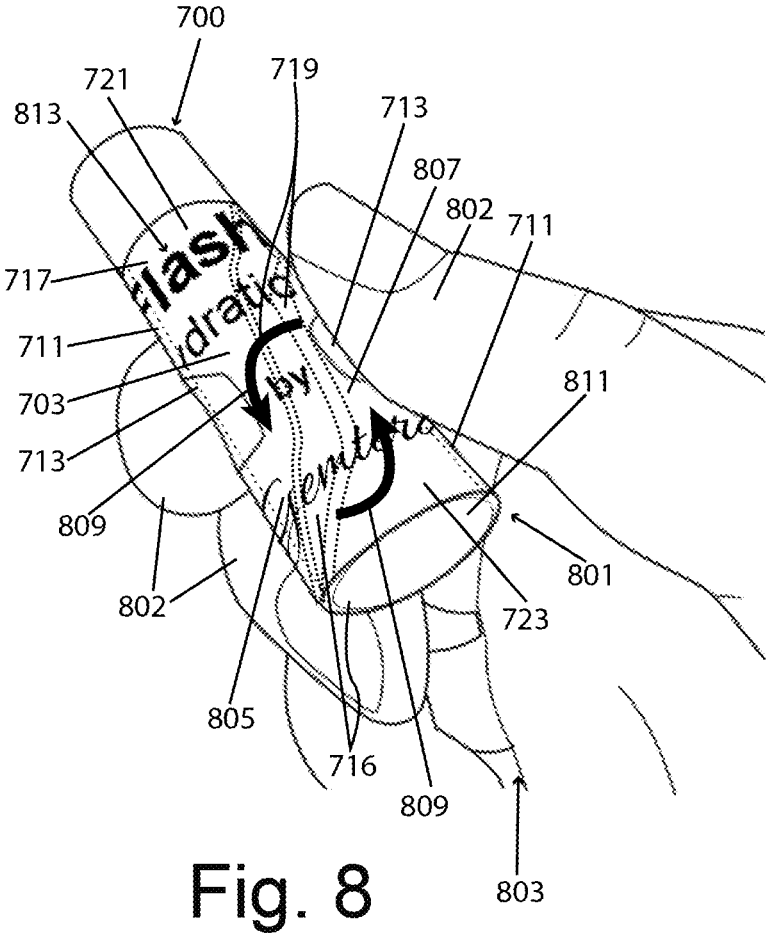
FIG. 8 is a perspective view of the transformable personal care fluid container, as it is transformed into a more rounded, or "bottle format," state by a user, in accordance with aspects of the present invention.

FIG. 8 is a perspective view of the same transformable personal care fluid container 700 set forth above, in FIG. 7, but in a transformed, more rounded, less flattened state 801 (e.g., a "bottle format") by a user, as discussed above, and in accordance with aspects of the present invention. As can be seen in the perspective of the figure, a user 803 has applied inward pressure, using her fingers 802 to press against the outer surfaces of to the two outer finger grips 713, and, as a result, driven stiff internal rods 711 inward, causing them to travel inward, toward one another, and causing flexible materials 716 within the housing 717 to bend outward, increasing the overall depth of housing 717 and personal care fluid container 700. Also as discussed above, this bowing continues until the stiff materials, such as stiff internal rods 711, resist one another (e.g., by comprising a limited-range hinge), and, in some embodiments, in conjunction with the flexible materials reaching an increased resistance from stretching, until stopping at a more rounded, generally cylindrical, or otherwise bottle-like shape, as shown in the present figure. In some embodiments, the resting state of transformable personal care fluid container 700, without the internal holding force of frangible internal wall 719 (when broken apart, and no longer intact) is rounded state 801. In other words, in some embodiments, the resting state of the flexible, spring materials in housing 717 is the rounded state 801, and the frangible internal wall (when intact) instead holds those flexible, spring materials in a loaded state, yielding he flattened reduced-profile state 701, shown in FIG. 7.

Also as discussed above, as the depth of transformable personal care fluid container 700 increased, leading to the more rounded state 801 shown, frangible internal wall 719 has broken apart, unsealing upper section 721 from lower section 723 of internal cavity 703. As a result of that inward pressure, and that breaking up (e.g., splitting as shown), ingredients or other components 805, formerly in upper section 721, mix freely with ingredients or other components 807, formerly in lower section 723, as shown by intermixing fluid movement arrows 809. In some embodiments, ingredients or other components 805 are denser than ingredients or other components 807, further encouraging this intermixing when transformable personal care fluid container 700 is then placed on a shelf or other horizontal surface.

It should be noted that transformable personal care fluid container 700 has a deeper bottom surface 811, which is a more stable base in some directions, than the bottom was in the flattened state set forth above, in FIG. 7. Also in some embodiments, a machine-readable code may be printed on or within the materials of the bottom surface 811 (and/or in some embodiments, on or within the materials of another surface, such as the top) of personal care fluid container 700, which identifies the ingredients enclosed and mixed within internal cavity 703 and their creation and packaging date. In some embodiments, that code also includes a time-altered code, such as an ink that begins to dissolve upon contact with fluids released from upper section 721, such that, when placed on a specialized shelf with a scanner and control system, the type of ingredients within personal care fluid container 700, and the activation time, can be determined and tracked. In some embodiments, however, the activation time (i.e., mixing of ingredients) may be assumed to be the time personal care fluid container 700 is first stowed such a specialized refrigerated shelf and/or cabinet. Method embodiments exhibiting the proper, upright storing of personal care fluid container 700, in such specialized refrigerated shelves and cabinets, are discussed in greater detail below.

Personal care fluid container 700 may be created from any known suitable combination of materials know in the art, in various embodiments. For example, in some embodiments, at least part of personal care fluid container 700 may be constructed from plastics. For example, in some embodiments, at least part of the components of personal care fluid container 700 may be constructed from polyethylene (PET). As another example, in some embodiments, the stiff internal rods 711 are created from metal, or include a metal. As another example, in some embodiments, the more flexible materials 716 are created from rubber or a pliable metal (such as a foil). In preferred embodiments, at least the parts of personal care fluid container 700 are created from a waterproof material, suitable for holding personal care fluids. In some embodiments, as pictured a label 813 may be placed on an outer surface of personal care fluid container 700. In some embodiments, that label is made into a desired or different shape (e.g., legible from illegible or less legible) in the transformation of personal care fluid container 700 to the rounded, less flattened state 801. In some embodiments, at least one material of personal care fluid container 700 is a transparent material, allowing a user to view the mixing and fill level of personal care fluid container 700.

Figure 9:
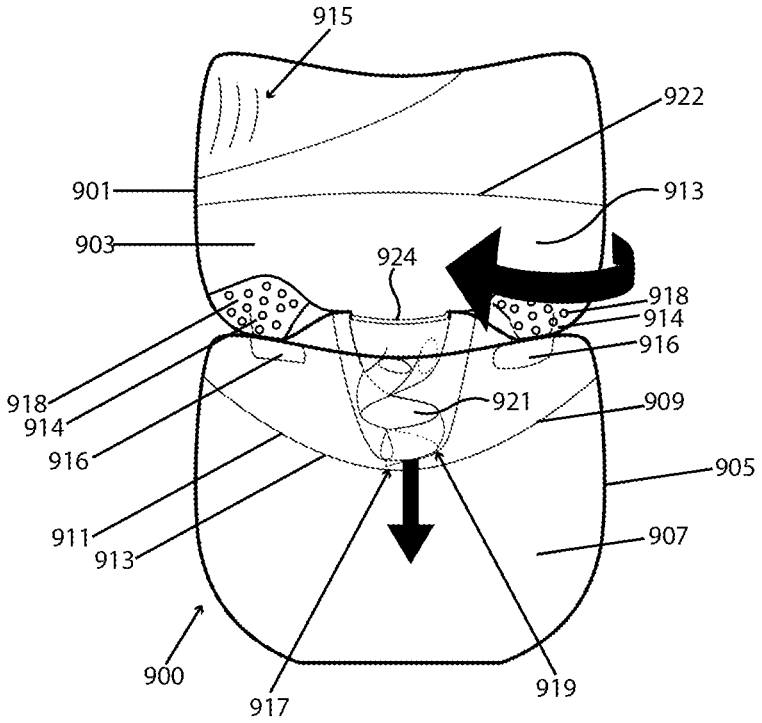
FIG. 9 is a side view of a new form of a multi-part container with combinable parts holding personal care fluids, in accordance with aspects of the present invention.

FIG. 9 is a side view of a new form of a multi-part container 900 with combinable parts holding personal care fluids, in accordance with aspects of the present invention. As pictured, multi-part container 900 may include an upper container 901, with an upper fluid-containing internal cavity 903, and a lower container 905, with a lower fluid-containing internal cavity 907. As with other personal care fluid containers set forth in the present application, in some embodiments, the upper cavity (upper fluid-containing internal cavity 903) may be filled with denser and/or more fluid ingredients than ingredients held within the lower cavity (lower fluid-containing internal cavity 907). Also as with other personal care fluid containers set forth in this application, the ingredients of each of the cavities may be intermixed and combined, upon a user breaking one or more seals separating the cavities. Some example techniques for so breaking seals, and new forms of such seals, are set forth in greater detail below.

In some embodiments, lower fluid-containing internal cavity 907 includes a downward-curved lower elastomeric seal 909. Downward-curved lower elastomeric seal 909 is attached to the inside of lower fluid-containing internal cavity 907 at anchor points far higher up vertically than its lowest point, resulting in a bowed downward curve 911. In some embodiments, this bowed downward curve results from a vacuum seal, which suctioned lower elastomeric seal 909 downward, against a fluid surface 913 (of a personal care fluid placed earlier within cavity 907), while removing any air between lower elastomeric seal 909 and fluid surface 913 (e.g., through a temporary hole in elastomeric seal 909, which is then sealed closed during filling and manufacturing multi-part container 900).

Figure 10:
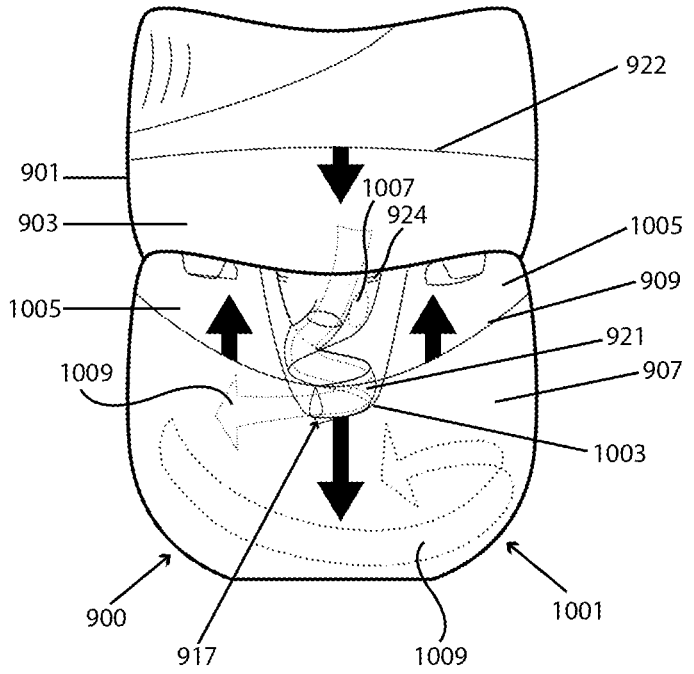
FIG. 10 is a side view of the same multi-part container with combinable parts holding personal care fluids, as set forth in FIG. 9, but in a new, combined state, and illustrating mixing and display aspects of the present invention.

To pierce elastomeric seal 909, and allow fluids to flow into lower fluid-containing internal cavity 907, a user may grip finger grips 915, and twist upper container 901 while driving it downward, in some embodiments, into elastomeric seal 909. This downward driving may be caused by that twisting, in some embodiments, due to helical members 914, engaging and threading into threading receivers 916 upon such twisting. However, in some embodiments, a user may simply drive upper container 901 into lower container 905. In either event, a flexible interconnection (e.g., rubber arms 918) may permit such driving, while maintaining a physical connection between upper container 901 and lower container 905. In some embodiments, the hole discussed above may then be reopened (e.g., by a piercing tip 917 at the lower-most point of a spiral fluid ejector 919). In some embodiments, as shown in FIG. 10, spiral fluid ejector 919 then penetrates through that hole, which maintains an air-tight seal around spiral fluid ejector 919, as it rises upwards (shown by upward movement vector arrows 1000). Upon such penetration, the upper fluid-containing internal cavity 903 and lower fluid-containing internal cavity 907 may then be in a more tightly conjoined state, in which personal care fluids in upper fluid-containing internal cavity 903 flow downward through spiral fluid ejector 919, and exhibit a spiral pattern (or, in some embodiments, other ornamental mixing patterns) as they eject into and mix with personal care fluids of lower fluid-containing internal cavity 907. To aid in that ejecting, both the negative pressure from tensioned elastomeric seal 909 which is transmitted through spiral tube 921, and positive pressure exerted by an upper seal 922 (similarly tensioned by suction methods used to tension elastomeric seal 909) pulled against upper personal care fluids 913, within upper fluid-containing internal cavity 903, combine at a total pressure great enough to break an internal seal 924, and drive upper personal care fluids 913 into lower fluid-containing internal cavity, with ornamental effects. These and other aspects will become clearer in reference to FIG. 10, below.

Multi-part container 900 may be created from any known suitable combination of materials know in the art, in various embodiments. For example, in some embodiments, all or part of multi-part container 900 may be constructed from plastics. For example, in some embodiments, all or part of the components of multi-part container 900 may be constructed from polyethylene (PET). As another example, in some embodiments, all or part of multi-part container 900 may be constructed from glass. In preferred embodiments, at least the parts of container 900 forming the fluid-containing internal cavities 903 and 907 are created from a waterproof, transparent material, suitable for holding personal care fluids.

FIG. 10 is a side view of the same multi-part container 900 with combinable parts holding personal care fluids, as set forth in FIG. 9, but in a new, combined state 1001, and illustrating mixing and display aspects of the present invention. As mentioned above, due to the downward driving of upper container 901, and the piercing tip 917 of its spiral tube 921 into and through lower elastomeric seal 909, lower elastomeric seal 909 begins to travel upwards, due to its upward tension, and due to the ability of fluids from upper fluid-containing internal cavity 903, to flow downward through spiral tube 921 after breaking internal seal 924 (discussed above). As a result, the combined positive pressure from upper seal 922 and negative pressure from lower elastomeric seal 909, which maintains a water- and air-tight seal around spiral tube 921's housing 1003, force fluids from upper fluid-containing internal cavity 903 downwards, along a curved path guided by spiral tube 921's curved walls.

Although, in some embodiments, a vacuum is located in the space 1005 within lower fluid-containing internal cavity 907 and above lower elastomeric seal 909, in some embodiments, air or another gas and/or fluid may be located in space 1005. In some such embodiments, an air exit port 1007 may be included within spiral a lower surface of upper container 901, to ease the displacement of air or such a fluid by the rising lower elastomeric seal 909.

In any event, as fluids from upper fluid-containing internal cavity 903 flow downwards, along the curved path guided by spiral tube 921, in some embodiments, ports throughout the surface of spiral tube 921's walls allow the steady transmission of fluids, along that curved path, creating a swirling, ornamental effect as those fluids mix with the ingredients of lower fluid-containing internal cavity 907. To enhance the appearance and forcefulness of such movements, and the resulting ornamental effect, and as mentioned elsewhere a denser fluid may be present within upper fluid-containing internal cavity 903 than in lower fluid-containing cavity 907, in some embodiments. Also to enhance the appearance of such movements, and the resulting ornamental effect, a different-colored fluid may be present within upper fluid-containing internal cavity 903 than in lower fluid-containing cavity 907, in some embodiments. Also to enhance the appearance of such movements, and the resulting ornamental effect, a visible reaction of the combined fluids may take place (e.g., foaming effect, phosphoric effect or a color-changing reaction), in some embodiments. Some examples of such resulting, ornamental mixing movements are demonstrated as swirling movement arrows 1009. In some embodiments, internal wall features of lower fluid-containing internal cavity 907 (e.g., spiral or other pattern scattering fins lining that wall) may further enhance such movements and visual effects.

Figure 11:
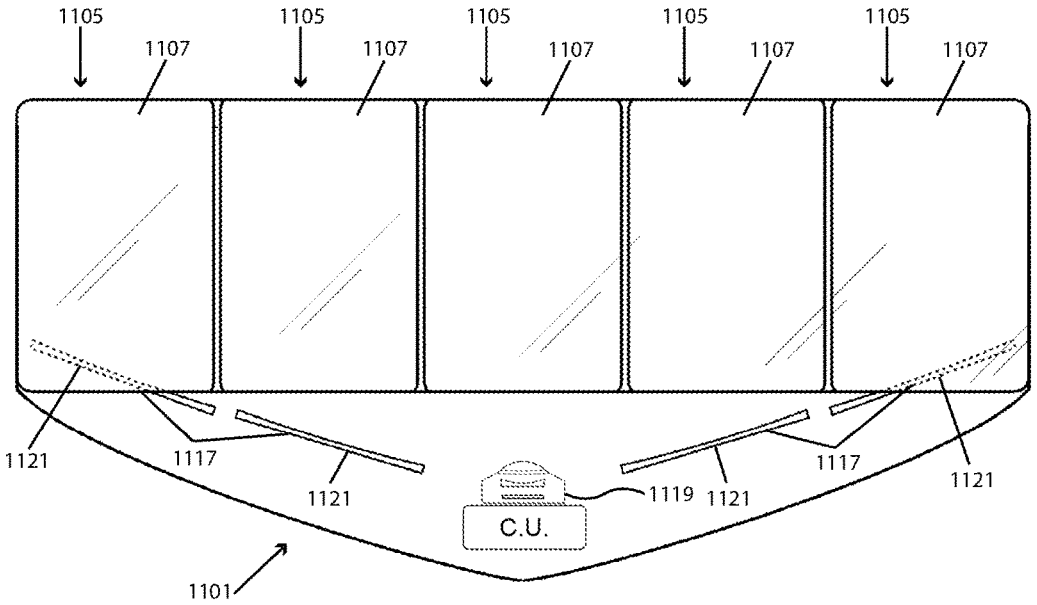
FIG. 11 is a front view of a new multi-compartment, refrigerating shelf system with individual personal care item tracking, labelling and reminder aspects for fresh personal care ingredients, in accordance with aspects of the present invention.

FIG. 11 is a front view of a new multi-compartment, temperature-regulating and/or refrigerating shelf system 1101 (hereinafter, for simplicity, "refrigerating shelf system"), with individual personal care product (e.g., personal care fluid or other material including personal care ingredients) tracking, labelling, instructions, information and reminder aspects, in accordance with aspects of the present invention. As with other devices and systems set forth in the present application, refrigerating shelf system 1101 comprises a control system (such as control unit 1120, discussed below) comprising computer hardware and software, such as the example control system set forth below in reference to FIG. 13, in some embodiments. Any of the devices and sub-devices set forth herein may be connected for instructions and communications (e.g., by electronic or other communications connections) with such a control system, and thereby may be controlled, managed and commanded by such a control system, in some embodiments. Refrigeration hardware (not pictured) is preferably present within a housing 1103 of multi-compartment, refrigerating shelf system 1101, in some embodiments. In some embodiments, such refrigeration hardware may include piezo-electric refrigeration hardware. In some embodiments, such refrigeration hardware may include a compressor. In some embodiments, such refrigeration hardware may include a vessel configured for cooling a space (e.g., a compartment, a.k.a., a "chamber," within refrigerating shelf system 1101) by decompression. For example, in some embodiments, such refrigeration hardware includes a gas-filled tank and a valve, configured to release gas within a cooling chamber and which, by releasing (e.g., when commanded by the control system, based on a temperature reading and a goal temperature for the cooling chamber, which may be selected based on the personal care product or container(s) located within the chamber), expands such gas, cooling the cooling chamber. In some embodiments, such a release of gas is carried out with a decompression valve operatively connected to the gas filled tank. In some embodiments, such a decompression valve is electronically actuated (e.g., by such a control system, which is connected thereto). In some embodiments, heating hardware (not pictured) is present within housing 1103 of multi-compartment, refrigerating shelf system 1101. In some such embodiments, such heating hardware includes an electronic heater.

As will be explained in greater detail below, a plurality of individual personal care product holding chambers may be present in some embodiments of refrigerating shelf system 1101. In such instances, each such chamber may be separately sealed and opened, and individually temperature-regulated, in some embodiments. For example, as discussed in greater detail below, in some embodiments, a plurality of access doors, each of which plurality of access doors is configured to separately seal and provide access to one of said plurality of storage compartments, are provided. In some embodiments, such individual temperature regulations for each such chamber are based on a determination (e.g., by scanning) of what personal care product container(s) and/or personal care product(s) are located within each such chamber. In some embodiments, the control system maintains a library of optimal storage temperatures and expiration times for such product(s) and/or ingredients thereof, and monitors and records temperatures experienced by the product container(s) or product(s) for particular periods of time, including, in some embodiments, lengths and points of time when the container(s) or products are held outside of the refrigerating shelf system 1101 at particular temperatures (e.g., by a container or product temperature upon return to the chamber using a thermometer testing the temperature within each chamber and/or, in some embodiments, another thermometer testing an ambient and/or user body temperature outside the refrigerating shelf system 1101).

Thus, in some embodiments, multi-compartment, refrigerating shelf system 1101 cools and/or maintains a constant temperature for each of a plurality of substantially-separated compartments, such as example plurality of substantially-separated compartments 1105, each with a separate chamber-sealing entrance door 1107, in some embodiments. The refrigeration and/or heating hardware (e.g., piezo-electric or other cooling unit(s)) separately temperature-regulating each of compartments 1105 may be controlled by and connected for supplying power and communications with, or comprised within, a control unit 1120, comprising or comprised within a control system (such as any of the control systems set forth below in reference to FIG. 13), which individually regulates the temperature of each of compartments 1105 in some embodiments. In some embodiments, individually-controlled refrigeration hardware is present, one each, in each of the separate chambers holding a personal care product and container and within the control system, allowing the control system to separately and specifically regulate the storage temperature of each personal care product held within refrigerating shelf system 1101. Similarly, in some embodiments, individually-controlled heating hardware, one each, in each of the separate chambers holding a personal care product and container and within the control system, allowing the control system to separately and specifically regulate the storage temperature of each personal care product held within refrigerating shelf system 1101.

As alluded to above, multi-compartment, refrigerating shelf system 1101 is in the format of a wall-mountable shelf, and may include wall-mounting hardware, in some embodiments (not pictured, since present on the opposite side of multi-compartment, refrigerating shelf system 1101 shown in the figure).

Additional individual personal care item tracking, labelling and reminder aspects for fresh personal care ingredients, in accordance with aspects of the present invention, will be set forth in greater detail below. It should be understood that, although refrigerating shelf system 1101 is referred to as "refrigerating," in some embodiments, whether or not refrigerating hardware is included, heating and other environmentally controlling hardware (e.g. humidifiers) may be used, instead of or in addition to such refrigerating hardware. In some such embodiments, refrigerating shelf system 1101 refers to the ability of the system to cease heating, resulting in cooling, chambers included within the system, or to otherwise regulate environmental aspects of such chambers. In still other embodiments, heat and other environmental regulatory aspects may be omitted, while the tracking, informational and instructional aspect of the invention may be included. Thus, refrigerating shelf system 1101 may alternatively, and accurately, be referred to alternatively as an "environmental regulation shelf system", or as a "usage-tracking personal care container shelf system," which may be more suitable in some embodiments.

Figure 12:
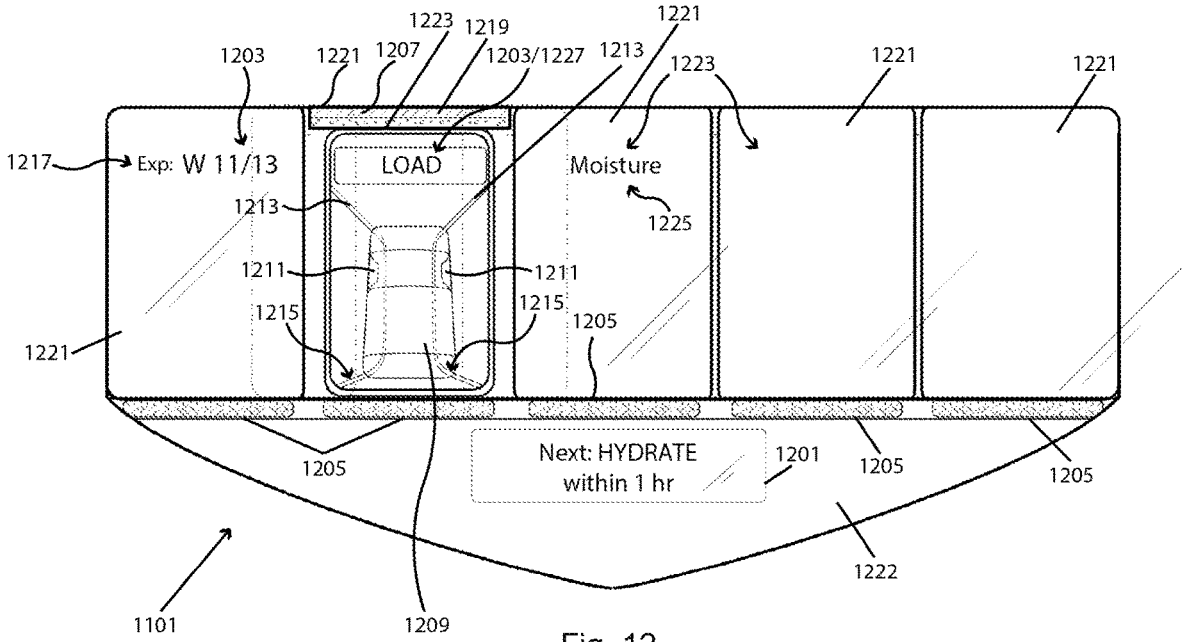
FIG. 12 is a front view of the same multi-compartment, refrigerating shelf system as set forth above, in reference to FIG. 11, illustrating some additional compartment opening, item stowing, usage and freshness controlling aspects of the present invention.

FIG. 12 is a front view of the same multi-compartment, refrigerating shelf system 1101 as set forth above, in reference to FIG. 11, illustrating some additional compartment-opening, item-stowing, usage and health-tracking, and freshness-controlling aspects of the present invention. As mentioned above, in some embodiments, refrigerating shelf system 1101 tracks and records the usage of personal care fluids and other skin and other health-relevant data and information, and provides instructions and information to the user based, in part, on that tracking and recording, in some embodiments. Such embodiments of refrigerating shelf systems may be referred to as a "usage-tracking personal care container shelf system" in this application, as mentioned above. For that purposes, in the present figure, additional user interface hardware is shown, including example main graphical display 1201. In some embodiments, one or more such graphical display(s) is configured to relay information and/or instructions to a user related to the user's personal care routine and/or health while said user is using said usage-tracking personal care container shelf system. In addition, or as an alternative, in some embodiments such graphical displays are in-door graphical displays 1203 (e.g., present within, and projected through, each door to each of the plurality of substantially-separated compartments 1105), which are provided. In any event, any such graphical display may be mounted within a mirrored surface comprised in a housing of said usage-tracking personal care container shelf system. In some such embodiments, such graphical display(s) are invisible within such a mirrored surface comprised in a housing of said usage-tracking personal care container shelf system unless and until it is activated and displaying at least some of said information. In some embodiments, at least part of such a graphical display is invisible within such a mirrored surface comprised in a housing of said usage-tracking personal care container shelf system unless and until such a part is activated and displaying at least some of said information. But, in some such embodiments, another part of said graphical display is visible within said mirrored surface comprised in the housing of said usage-tracking personal care container shelf (e.g., when said another part is activated and displaying at least some information).

Thus, in some embodiments, a graphical display is mounted within a mirrored surface comprised in a housing of said usage-tracking personal care container shelf system, and located within at least one of a plurality of access doors of the plurality of substantially-separated compartments. In some such embodiments, such a graphical display mounted within a mirrored surface comprised in each of said plurality of access doors, and, respectively, each such graphical display relays information related to each personal care container held behind each of said plurality of access doors.

Also in addition, or as an alternative, in some embodiments, an array of status-indicating multi-color capable indicator lights 1205, one-each, presented abutting each such door, are provided, in some embodiments. Thus, in some embodiments, each of a plurality of access doors comprises one of a plurality of graphical displays comprised in said system. In some such embodiments, the control system is configured to display information related to a container held within a compartment sealed by one of said plurality of access doors on one of said graphical displays mounted within said one of said plurality of access doors.

One such door, second door from the left-hand side 1207, is shown as having been lifted upward into an open position, swiveling on an upper hinge, and exposing interior aspects of the second compartment from the left of plurality of substantially separated compartments 1105. As can be seen in this open position, each compartment may include a form-fitting stowing casement, which substantially surrounds and contacts a personal care fluid container of a matching shape placed within it. For example, in some embodiments, the transformable personal care fluid container 700, in rounded state 801, may be such a personal care fluid container in such a matching shape. As mentioned elsewhere, in some embodiments, personal care fluid containers in accordance with this application may be switchable between multiple physical conformations, and mixing states, in some embodiments. For example, in some embodiments, a personal care fluid container may have a flattened state, but be switchable to a more rounded state. In some such embodiments, such a personal care container comprises an actuable housing, configured to change its shape between such multiple states (e.g., to become less flat, and take on the shape of a cylindrical, box, cone or other form of bottle) when actuated. In some embodiments, such an actuable housing reveals a unique code or label when actuated (e.g., on a bottom surface of the resulting bottle). In some embodiments, such a unique code is not readable until the personal care fluid container is so switched (i.e. "converted") to a bottle-like state. In some embodiments, personal care fluid containers are transparent or otherwise permit one or more cameras or other sensors to observe and analyze the contents of the personal care fluid containers. In any event, in some embodiments, the personal care fluid containers comprise a housing material which screens or blocks ultraviolet light (U.V.) to prevent degradation of the personal care fluids held within them. In some embodiments, the personal care fluid containers are scanned and uniquely identified prior to shipment to a user, and information related to that scan is recorded by a control system. In some embodiments, the contents of personal care fluid containers are observed and analyzed prior to shipment to a user, and information related to that observation and analysis is recorded by a control system. In some embodiments, such information is information related to an analyte. In some embodiments, personal care fluid containers and/or the contents thereof are weighed or otherwise assessed, and recorded, prior to shipment to a user. In some embodiments, a mass of contents of the personal care containers is determined and recorded prior to shipment to a user. In some embodiments, a plurality of elements and/or compounds, and a proportion thereof within said personal care container(s), are determined and recorded prior to shipment to a user. In some such embodiments, such a plurality of elements and/or compounds, and a proportion thereof are determined by spectroscopy. In some embodiments, such a plurality of elements and/or compounds, and a proportion thereof are determined by weight and/or density of said contents.

As discussed elsewhere in this application, in some embodiments, information concerning a user's health and/or use of personal care fluids administered with the aid of the usage-tracking personal care container shelf system is determined and recorded by a control system included in the usage-tracking personal care container shelf system. In some embodiments, the contents of personal care fluid containers are observed and analyzed by scale(s), camera(s), and/or other sensor(s) present within the personal care container shelf system (i.e., after shipment to a user). In some such embodiments, information related to that observation and analysis is recorded by a control system. In some embodiments, such information is compared to information recorded prior to shipment, and inferences concerning consumption of personal care fluids and other health-relevant data are inferred by the control system. In some embodiments, such information is information related to an analyte. In some embodiments, personal care fluid containers and/or the contents thereof are weighed or otherwise assessed, and recorded, after shipment to a user and use by the user. In some embodiments, information that is recorded by the control system included in the usage-tracking personal care container shelf system is related to the contents of said personal care product container comprises information and related to the weight of contents of said personal care container. In some embodiments, information related to the contents of a personal care product container includes information related to the volume of contents of said personal care container. In some such embodiments, such a usage-tracking personal care container shelf system includes a camera(s) or fluid level sensor(s) configured to sense a fluid level within at least one personal care fluid container held within the usage-tracking personal care container shelf system. In some embodiments, the at least one camera(s) or sensor(s) is located at the bottom of, or beneath, a plurality of storage compartments of the usage-tracking personal care container shelf system. In some embodiments, the usage-tracking personal care container shelf system comprises at least one scale. In some embodiments, a mass of contents of the personal care containers is determined and recorded after shipment to a user and use by the user. In some embodiments, a plurality of elements and/or compounds, and a proportion thereof within said personal care container(s), are determined and recorded after shipment to a user and use by a user. In some such embodiments, such a plurality of elements and/or compounds, and a proportion thereof are determined by spectroscopy. In some embodiments, such a plurality of elements and/or compounds, and a proportion thereof are determined by weight and/or density of said contents. In some embodiments, each of the plurality of substantially-separated compartments includes a scale(s), camera(s) or other sensor(s), to generate any of the above information. In some embodiments, any or all of such scale(s), camera(s) or other sensor(s) may be located below or at the bottom of the plurality of substantially-separated compartments. In some embodiments, such camera(s) or sensor(s) is positioned within said usage-tracking personal care container shelf system at a location with an open line-of-sight to a code or label on said at least one of said personal care container(s) when held within such a plurality of substantially-separated compartments. As will be discussed in greater detail below, a mirror located below or at the bottom of the plurality of substantially-separated compartments may be angled to provide such line-of-site with a camera or sensor, in some embodiments.

As also can be seen, bottle- or other container-fitting ribs 1211 may be included, which may grip a personal care fluid container placed into stowing casement 1209. Thus, via a variety of different possible physical interfaces, the compartment(s) include a bracket or other personal care product container-conforming hardware, with at least one surface matching and/or conforming to an exterior surface of said personal care fluid container, in some embodiments, as pictured. In some embodiments, cooling fluid transmitting conduits 1213 may be included. In some embodiments, cooling fluid transmitting conduits 1213 may be gaps with tolerances 1215, through which cooled air from the cooling unit (e.g., from an air conditioning unit). In some embodiments, such conduits and gaps are narrow enough to substantially prevent the escape of significant amounts of cooled fluids, even when a door to one of the plurality of substantially-separated compartments 1105 has been opened, as pictured.

In some embodiments, each personal care fluid container placed into any of plurality of substantially-separated compartments 1105 contains a unique code or label which is scanned by the control system, uniquely identifying the personal care container and product (e.g., the contents or ingredients thereof) and which may state or encode information related to the contents of a personal care product within the respective personal care fluid container. In some embodiments, such information related to the contents of a personal care product includes any or all of the following: 1) the date of manufacture and/or filling of the personal fluids in that container, 2) the mixing or activation state of the ingredients within each such container, 3) the type and amounts of ingredients within each such container (e.g., a weight, proportion or volume of such ingredients), 4) the level of their use (e.g., amount of fluids present and taken from the personal care container, by weight or volume) over time by a user, 5) a quality of a fluid held within said personal care product container (e.g., its density, color, viscosity, sterility or preservation state, excipients, uses, recommended administration routine, etc.). In some embodiments, as discussed elsewhere in this application, that code and/or label is present or readable on the bottom surface of each such personal care fluid container. In some embodiments, a label, rather than a code, is present on or within the personal care fluid container, relaying such information, which can be read by a user and/or the control unit control system.

In some embodiments, a user uses a single scanner located on or about the outer housing 1103 of multi-compartment, refrigerating shelf system 1101, and connected with the control unit, to scan each such personal care fluid container as it is put into multi-compartment, refrigerating shelf system 1101. In some such embodiments, based on the door that is opened (simultaneously, after, or just prior to such scanning, in various embodiments), the control unit may determine that the personal care fluid container scanned has been placed within the corresponding one of the plurality of substantially-separated compartments 1105, and record data related to that personal care container in memory, in some embodiments. In other embodiments, however, a plurality of scanners, each connected to control unit 1120, are provided, and each such scanner may be provided adjacent to each of the plurality of substantially-separated compartments 1105, near where the codes or labels are located when a personal care fluid container is placed within them. In some embodiments, as shown in FIG. 11, a single scanner may scan each and every personal care fluid container, located (one-each) in each of the plurality of substantially-separated compartments 1105, via an array of mirrors, such as exemplary array of mirrors 1117, located below and at reflecting angles permitting scanning from a single visual sensor 1119. In some embodiments, array of mirrors 1117 includes a set of enlarging convex mirrors 1121, each of which is placed and angled to permit visual sensor 1117 (which is preferably a fisheye or other wide-lens camera with at least a 180-degree viewing angle, connected with control unit 1120) to view code labels on the bottom of each personal care fluid container placed in any of the plurality of substantially-separated compartments 1105. To aid that viewing, the lower surface of each of the plurality of substantially-separated compartments 1105 is preferably highly transparent. In some embodiments, a micro-sampling and analysis device(s) may be provided (e.g., one each within each of substantially-separated compartments 1105). In some such embodiments, at least one personal care fluid container placed within one of substantially-separated compartments 1105 is configured to have a very small, but sufficient for testing, volume of its fluid extracted by and into a small transparent pipette or other testing vessel of the micro-sampling and analysis device. In some embodiments, such a micro-sampling and analysis device and/or the personal fluid container, includes a one-way valve, preventing the flow of air into said personal care container during sampling by said micro-sampling and analysis device. In some embodiments, such a micro-sampling and analysis device and/or the personal fluid container, includes a seal, preventing the flow of air into said personal care container during sampling by said micro-sampling and analysis device. In some embodiments, upon extraction from the personal fluid container, a scanner, camera, probe or other sensor of the micro-sampling and analysis device may test and analyze that small volume of fluid, and the control system may then record data related to that test and analysis as relating to the personal care fluid. For example, in some embodiments, such a test and analysis relates to a state of degradation of at least some ingredients within the personal care fluid. As another example, in some embodiments, such a test and analysis relates to a purity level of at least some ingredients within the personal care fluid.

Turning back to FIG. 12, as the information relevant to each personal care fluid container is scanned, the control system may create a system of visual and other reminders, updates and informational displays for a user, to aid in governing that user's personal care routine, in some embodiments. For example, as shown by example in-door graphical display 1217, the control system may alert the user to an expiration date of the personal care fluid container placed in the first compartment from the left of the plurality of substantially-separated compartments 1105. Each of the plurality of substantially-separated compartments 1105 may contain a similar, individually controlled display, which may be bright enough to shine through a silvered or otherwise semi-transparent outer door layer 1219, in some embodiments. In this manner, all of the covering doors 1221, over each of the plurality of substantially-separated compartments 1105, may form a larger mosaic mirror, with which the user may view herself, aiding in applying personal care products. In some embodiments, an additional, single-piece mirror, may extend the total mirrored surface 1222, adjacent to the plurality of substantially-separated compartments 1105. Another, insulating layer 1223, may also be present within each of covering doors 1221, and preferably is fully transparent, in some embodiments. In some embodiments, in-door graphical displays may also, or alternatively, indicate the type of personal care fluid contained within the corresponding compartment. For example, third door from the left-hand side 1207's in-door display 1225 indicates that a moisturizer is present in the corresponding compartment it covers. In some embodiments, if the personal care fluid within a compartment is not expired, or due to expire soon, other information such as this is, instead, displayed. In other embodiments, the amount remaining in the personal care fluid bottle may instead, or in addition, be reported in such an in-door display. In some embodiments, when no personal care fluid container is presently loaded, a command to load such a container may be indicated, as with in-door display indicator 1227. In some embodiments, status-indicating multi-color capable indicator lights 1205 may indicate whether the above-stowed personal care container is expired (e.g., glowing red), low in amount (e.g., glowing yellow) or still fresh with sufficient quantities, based on the user's needs (which may be stored within the control unit. Also based on the users' needs so stored, main graphical display 1201 may provide instructions, pointers and other information aiding the user in performing her personal care routine. For example, in the instance pictured, main graphical display 1201 is providing the instruction that the user use a moisture to hydrate her skin, within the next hour, based on her programmed routine. In some embodiments, the control unit is specially programmed with general personal care guidelines for humans, and particular guidelines based on that user's skin care routine, and what behaviors have enhanced her personal care routine in the past. For example, in some embodiments, the control unit uses observation (e.g., through user-facing cameras) and machine learning to determine when the user's physical appearance is enhanced, and associates the user's recently observed personal care fluid usage with that enhanced appearance.

In some embodiments, the alerts, reminders, and other data provided to a user through any of the above displays, (and/or, in some embodiments, other forms of feedback, such as auditory or haptic feedback) may be based on an algorithm programmed into the control system of the control unit. For example, in some embodiments, such an algorithm may be based on the control system's determination that use of certain personal care products, with particular characteristics related to them and stored in the control systems memory, are associated in time with a beneficial health or physical appearance outcome observed by the control system (e.g., using a user-facing camera on the outer housing 1103 and/or a mirror of multi-compartment, refrigerating shelf system 1101), or noted by the user through data entry (using a G.U.I. and controls, such as main graphical display 1201, or any other display, which may also comprise a touch screen, presenting such a G.U.I., in some embodiments).

In some embodiments, the control system generates suggestions and information displayed to the user related to a skin or body temperature(s) of a user (e.g., with a thermometer within said system) of the usage-tracking personal care container shelf system. In some embodiments, the control system generates suggestions and information related to a complexion(s) (e.g., with a camera within said system) of a user of the usage-tracking personal care container shelf system. In some embodiments, the control system generates suggestions and information related to an application or other consumption of a personal care product held within at least one personal care container(s) of a user of said usage-tracking personal care container shelf system. In some embodiments, the control system generates suggestions and information related to at least one behavior and/or activity of a user of the usage-tracking personal care container shelf system. In some embodiments, the control system generates suggestions and information related to a physical condition of a user of said usage-tracking personal care container shelf system. In some embodiments, the control system generates suggestions and information related to a growth on the body of a user of said usage-tracking personal care container shelf system. In some embodiments, the control system generates suggestions and information related to an indicator of health of a user of said usage-tracking personal care container shelf system. In some embodiments, the usage-tracking personal care container shelf system tracks exercise by a user of said usage-tracking personal care container shelf system. In some embodiments, the control system generates suggestions and information identifying a user of said usage-tracking personal care container shelf system. In some embodiments, the control system generates biometric information related to a user of said usage-tracking personal care container shelf system. In any of the above embodiments, the usage-tracking personal care container shelf system determines and records information related to any of the above information.

Figure 13:
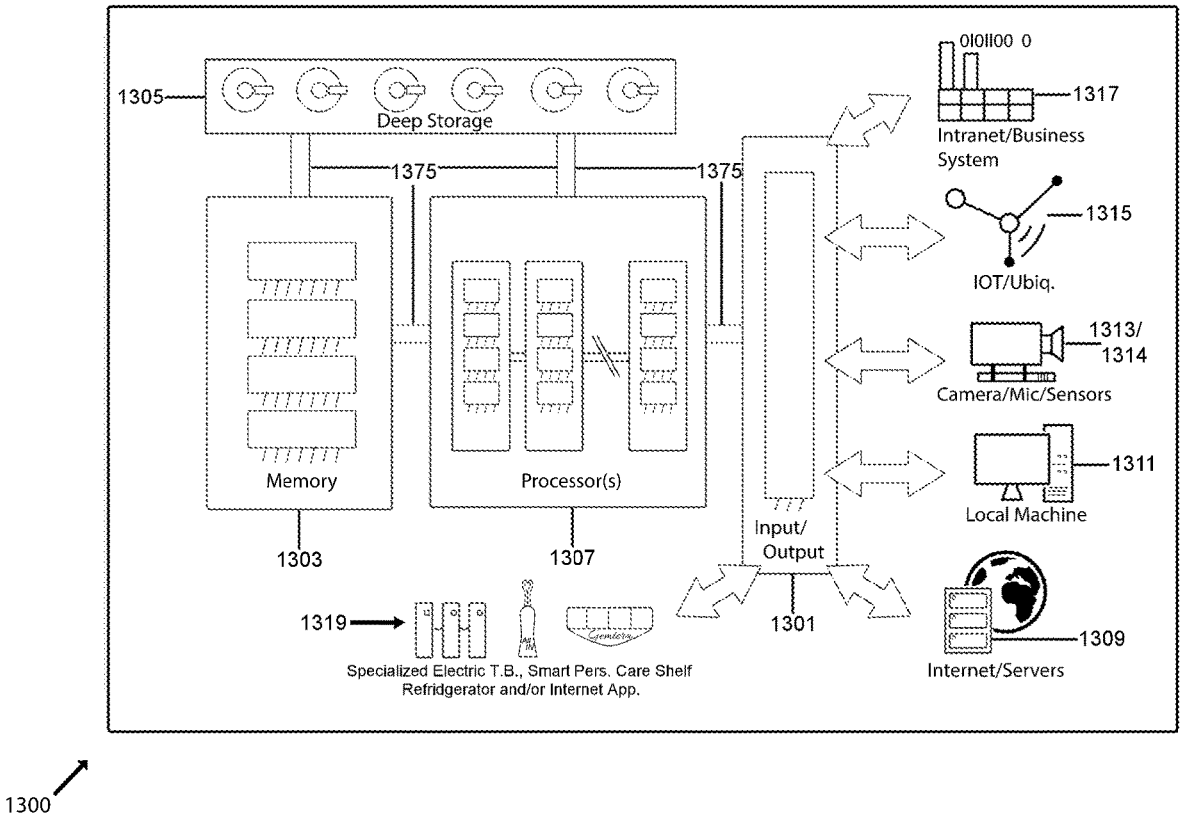
FIG. 13 is a schematic block diagram of some example elements of an example control system, including computer hardware and preferably incorporating a non-transitory machine-readable medium, that may be used to implement various aspects of the present invention, some of which aspects are described in reference to FIGS. 1-12, above.

FIG. 13 is a schematic block diagram of some example elements of an example control system 1300, including computer hardware and preferably incorporating a non-transitory machine-readable medium, that may be used to implement various aspects of the present invention, some of which aspects are described in reference to FIGS. 1-12, above. The generic and other components and aspects described herein are not exhaustive of the many different control systems and variations, including a number of possible hardware aspects and machine-readable media, that might be used, in accordance with embodiments of the invention. Rather, the control system 1300 is described herein to make clear how aspects may be implemented.

Among other components, the control system 1300 may include an input/output device 1301, a memory device 1303, longer-term, deep data storage media and/or other data storage device 1305, and a processor or processors 1307. The processor(s) 1307 is (are) capable of receiving, interpreting, processing and manipulating signals and executing instructions for further processing and for output, pre-output and/or storage in and outside of the control system 1300. The processor(s) 1307 may be general or multipurpose, single- or multi-threaded, and may have a single core or several processor cores, including microprocessors. Among other things, the processor(s) 1307 is (are) capable of processing signals and instructions for the input/output device 1301, to cause a user interface to be provided or modified for use by a user on hardware, such as, but not limited to, a personal computer monitor or terminal monitor with a mouse and keyboard and presentation and input-facilitating software (as in a GUI), or other suitable GUI presentation system (e.g., on a smartphone touchscreen, and/or peripheral device screen, or an appliance with graphical displays, such as the multi-compartment, refrigerating shelf system 1101 as set forth above, in reference to FIGS. 11 and 12 and/or with other ancillary sensors, cameras, devices, any of which may include user input hardware, as discussed elsewhere in this application with reference to various embodiments).

For example, in some embodiments, camera(s) or other sensor(s) and other user interface aspects may gather input from a user and present user(s) with selectable options, such as preconfigured commands or data input tools and sub-tools, to interact with hardware and software of the control system and monitor a user's personal care routine (e.g., personal care fluid use, applications, user behaviors, biomarkers, data and extrapolations from those data, at particular times). For example, in some such embodiments, a user may interact with the control system through any of the actuation and user interface techniques set forth in this application, such as by actuating data input device, code scanners, and inputing data related to personal care, or to carry out any other actions set forth in this application for a control system. The processor(s) 1307 is/are capable of processing instructions stored in memory devices 1305 and/or 1303 (or ROM or RAM), and may communicate via system buses 1375. Input/output device 1301 is capable of input/output operations for the control system 1300, and may include and communicate through innumerable input and/or output hardware, and innumerable instances thereof, such as a computer mouse(s), or other sensors, actuator(s), communications antenna, keyboard(s), smartphone(s) and/or PDA(s), networked or connected additional computer(s), camera(s) or microphone(s), mixing board(s), reel-to-reel tape recorder(s), external hard disk recorder(s), additional movie and/or sound editing system(s) or gear, speaker(s), external filter(s), amp(s), preamp(s), equalizer(s), filtering device(s), stylus(es), gesture recognition hardware, speech recognition hardware, computer display screen(s), touch-screen(s), sensors overlaid onto touchscreens, or other manually actuable member(s) and sensor(s) related thereto. Such a display device or unit and other input/output devices could implement a program or user interface created by machine-readable means, such as software, permitting the system and user to carry out the user settings and other input discussed in this application. 1301, 1303, 1305, and 1307 are connected with and able to send and receive communications, transmissions and instructions via system bus(es) 1375. Deep storage media device 1305 is capable of providing mass storage for the system, and may be a computer-readable medium, may be a connected mass storage device (e.g., flash drive or other drive connected to a U.S.B. port or Wi-Fi), may use back-end or cloud storage over a network (e.g., the Internet) as either a memory backup for an internal mass storage device or as a primary memory storage means, and/or may simply be an internal mass storage device, such as a computer hard drive or optical drive.

Generally speaking, the system 1300 may be implemented as a client/server arrangement, where features of the invention are performed on a remote server, networked to the client and made a client and server by software on both the client computer and server computer. System 1300 is capable of accepting input from any of those devices and systems 1309-1319, and modifying stored data within them and within itself, based on any input or output sent through input/output device 1301.

Input and output devices may deliver their input and receive output by any known means, including, but not limited to, any of the hardware and/or software examples shown as 1309-1319.

While the illustrated example system 1300 may be helpful to understand the implementation of aspects of the invention, any suitable form of computer system known in the art may be used—for example, a simpler computer system containing just a processor for executing instructions from a memory or transmission source—in various embodiments of the invention. The aspects or features set forth may be implemented with, and in any combination of, digital electronic circuitry, hardware, software, firmware, modules, languages, approaches or any other computing technology known in the art, any of which may be aided with external data from external hardware and software, optionally, by networked connection, such as by LAN, WAN or the many connections forming the Internet. The system can be embodied in a tangibly-stored computer program, as by a machine-readable medium and propagated signal, for execution by a programmable processor. Any or all of the method steps of the embodiments of the present invention may be performed by such a programmable processor, executing a program of instructions, operating on input and output, and generating output and stored data. A computer program includes instructions for a computer to carry out a particular activity to bring about a particular result, and may be written in any programming language, including compiled and uncompiled and interpreted languages and machine language, and can be deployed in any form, including a complete program, module, component, subroutine, or other suitable routine for a computer program.

Figure 14:
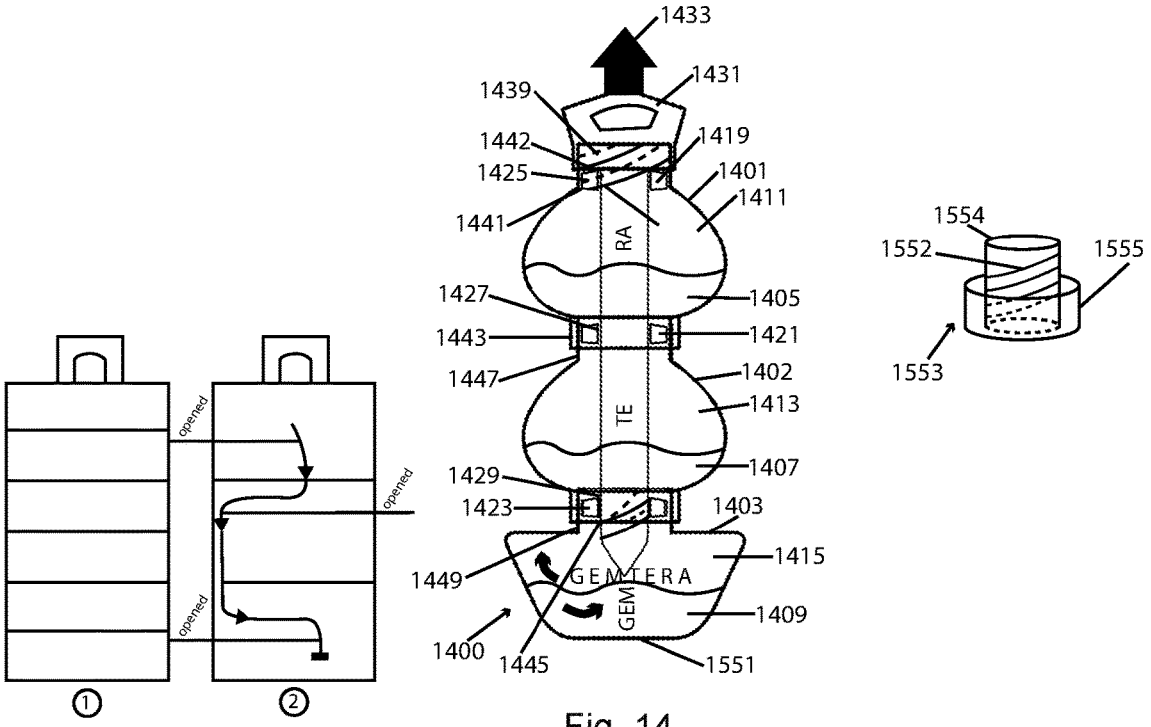
FIG. 14 is a side view of another example multi-unit personal care fluid container, in accordance with some embodiments of the invention.

FIG. 14 is a side view of another example multi-unit personal care fluid container 1400. In some embodiments, personal care fluid container 1400 includes a plurality of personal care fluid storing units, such as example fluid storing unit 1401, example fluid storing unit 1402 and example fluid storing unit 1403. As with other personal care fluid containers, and parts thereof, set forth in this application, fluid storing unit 1401, fluid storing unit 1402 and fluid storing unit 1403, each of which include a fluid storage cavity, may each contain a personal care fluid or ingredient, such as example personal care fluid or ingredient 1405, personal care fluid or ingredient 1407 and personal care fluid or ingredient 1409. Also as with other personal care fluid containers, and parts thereof, set forth in this application with a vertical, under/over arrangement when the personal care fluid container is placed upright, as pictured, higher up fluid storage cavities, such as fluid storage cavity 1411 and fluid storage cavity 1413, within fluid storing unit 1401, and fluid storing unit 1402, respectively, may be holding personal care fluid(s) of a higher fluidity in some embodiments, than personal care fluid(s) within lower fluid storage cavities, such as fluid storage cavity 1415.

As a result, when a central rod 1417, which serves as a stopper, holding example personal care fluid or ingredient 1405, personal care fluid or ingredient 1407 and personal care fluid or ingredient 1409 within fluid storage cavity 1411, fluid storage cavity 1413 and fluid storage cavity 1415, respectively, is removed from its water-tight seal within (e.g., rubber) ring or other shaped bottleneck seal 1419, ring or other shaped bottleneck seal 1421 and ring or other shaped bottleneck seal 1423, those higher density personal care fluids will flow downward, with the force of gravity, migrating toward the lower fluid storage cavity 1415, regardless of how completely filled any of those fluid storage cavities are. To aid in this flow and migration, ports within each of ring or other shaped bottleneck seal—namely, port 1425, port 1427 and port 1429, within ring or other shaped bottleneck seal 1419, ring or other shaped bottleneck seal 1421 and ring or other shaped bottleneck seal 1423, respectively—are of a sufficient width to prevent the colligative forces of those higher density fluids from preventing that downward flow and migration. For example, in some embodiments, in which those fluids are highly fluid, 70% aqueous solutions, each of port 1425, port 1427 and port 1429 are at least 2 mm in diameter. In some preferred embodiments, each of port 1425, port 1427 and port 1429 are at least 5 mm in diameter. In some preferred embodiments, each of port 1425, port 1427 and port 1429 are at least 8 mm in diameter. In some preferred embodiments, each of port 1425, port 1427 and port 1429 are at least 10 mm in diameter. In some preferred embodiments, each of port 1425, port 1427 and port 1429 are at least 12 mm in diameter. In some preferred embodiments, each of port 1425, port 1427 and port 1429 are at least 15 mm in diameter. In some preferred embodiments, each of port 1425, port 1427 and port 1429 are at least 20 mm in diameter.

To aid in removing central rod 1417 from at least one (port 1429) of port 1425, port 1427 and port 1429, a combination rod handle and top 1431 is included, in some embodiments. Thus, in some embodiments, a user may grab rod handle and top 1431, and pull it upwards, as demonstrated by upward vector/force arrow 1433, to release personal care fluids, allowing them to flow and migrate downwards, as discussed above.

In some embodiments, rod handle and top 1431 is attached to or integral with a threaded or otherwise water-tight fastening bottle top 1435. For example, female spiral threading 1437 within the inner sides of such a water-tight fastening bottle top 1435 may interlock with complementary outer spiral threading 1439, about bottle neck 1441 of the top-most fluid storing unit (fluid storing unit 1401), and a user may twist rod handle and top 1431 relative to the top-most fluid storing unit, to create a water-tight seal (e.g., twisting clockwise) and loosen (e.g., twisting counter-clockwise) between water-tight fastening bottle top 1435 and the upper lip 1442 of bottle neck 1441. In some embodiments, some of the personal care fluid storing units (other than the bottom-most personal care fluid unit 1403) include a bottom valence, such as bottom valence 1443 and bottom valence 1445. As with water-tight fastening bottle top 1435, each of these valences may have inner (female) screw threading, of the same size, and also complementary to male screw threading on the outside of bottle neck 1447, bottle neck 1449 and, in some embodiments, bottle neck 1441, discussed above, forming a water-tight seal with any of those bottle necks. Thus, in some embodiments, the vertical order of at least the different upper personal care fluid storing units (other than personal care fluid unit 1403) may thus be altered, by loosening, interchanging their positions, and tightening them together via their threading. However, in some embodiments, the bottom-most personal care fluid unit 1403 may have a flat bottom 1551, with no bottom valence, and thus must be used as the bottom unit. However, in some embodiments, the bottom-most unit may be of substantially the same, or a similar, form as example fluid storing unit 1401, example fluid storing unit 1402. In such instances, a bottom cap 1553 may be included, in some embodiments, with a central cylindrical member 1554 which also includes external (male) threading 1552 complementary to, and interlockable with, a bottom valence of flat bottom 1551, which may be of the same size, shape and complementary female threading discussed above. To aid in forming a watertight seal, in some embodiments, an external, sealing lip, which envelopes the outer housing 1555 of any of the valences (e.g., plastic, rubber-lined, or otherwise including a sealing material) may be included, in some embodiments. In some embodiments, any of the presentation techniques set forth in this application may be added to personal care fluid container 1400—such as, but not limited to, guides, ramps, reactions or other visual display techniques, on or about any of the fluid-holding cavities.

As a method for filling a multi-unit personal care fluid container, such as multi-unit personal care fluid container 1400, a factory worker, robotic machine, or other manufacturer, may first invert personal care fluid container 1400, without central rod 1417 fully inserted. The manufacturer may then insert central rod 1417 part-way, such that it has pierced and formed a watertight seal with ring or other shaped bottleneck seal 1419, but not with ring or other shaped bottleneck seal 1421 or 1423, yet. The manufacturer may then fill fluid storage cavity 1411 with a personal care fluid, through port 1427. The manufacturer may advance the central rod 1417, more fully inserting it, through port 1427, sealing in that personal care fluid into fluid storage cavity 1411. However, again, the manufacturer does not yet fully advance central rod 1417 as pictured, this time leaving port 1429 open, and filling fluid storage cavity 1413 with a different (e.g., less dense) personal care fluid. The manufacturer then more fully advances central rod 1417, penetrating port 1429, and forming a watertight seal, holding in the different personal care fluid within fluid storage cavity 1413. In some embodiments, fluid storage cavity 1415 may remain empty, and fluid storage unit 1403 may be screwed in to place, sealing it with valence 1445. Thus, in those embodiments, when central rod 1417 is later pulled out of multi-unit personal care fluid container 1400, all of personal care fluids descend from within, and mix within fluid storage cavity 1415. In some embodiments, this mixing may include ornamental effects and techniques, as set forth above for other multi-unit personal care fluid containers.

Of course, as with other aspects of inventions set forth in this application, a wide variety of alternative or additional configurations, numbers, orders and instances of any aspect may be included, and fall within the scope of the present embodiments. For example, in some embodiments, the fluid storage cavities may be organized in a side-by-side, horizontal configuration. For example, in some such embodiments, a central separating wall, rather than a rod, may be used to variably seal and unseal the individual cavities and fluids contained therein, as shown by example wall-separated box configurations 1 and 2.

Figure 15:
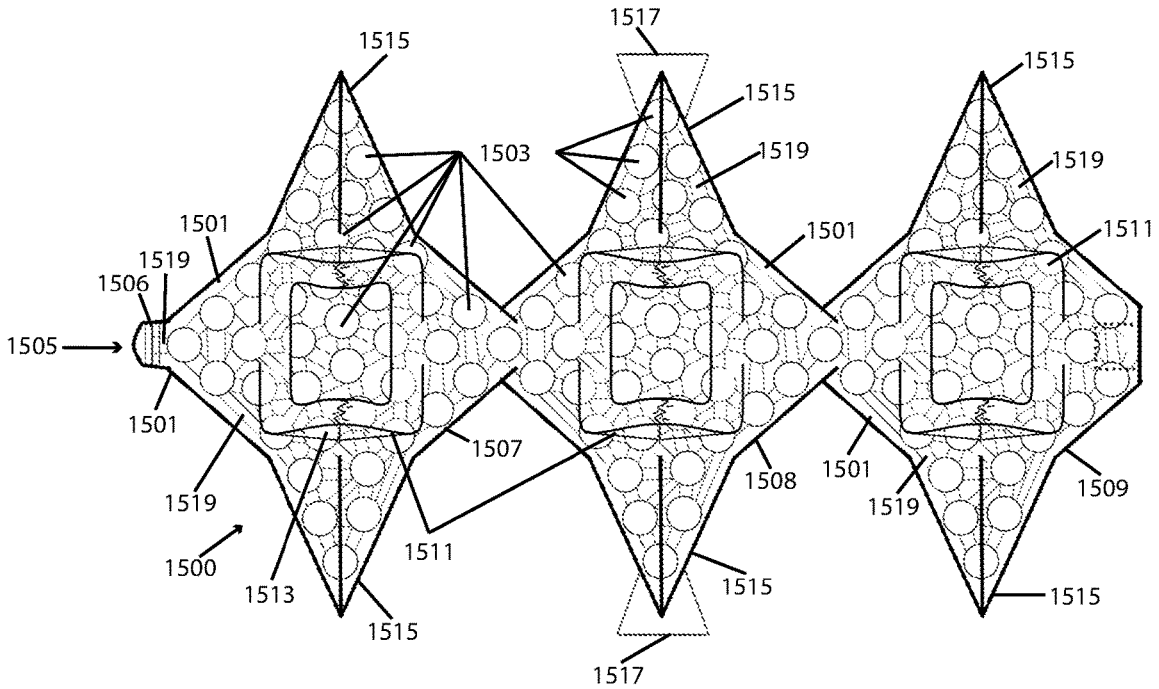
FIG. 15 is a side view of an example consumer-inflatable packing strip, with a plurality of segments, in accordance with some embodiments of the present invention.

FIG. 15 is a side view of an example consumer-inflatable packing strip 1500, with a plurality of segments, in accordance with some embodiments of the present invention. In some embodiments, consumer-inflatable packing strip 1500 is constructed, at least in part, of a flexible, soft, airtight material, such as thin plastic (e.g., polyethylene). In various embodiments, or any other material suitable for manufacturing air-tight, adhesive tapes, inflatable cushioning devices, and/or packing materials. In some embodiments, consumer-inflatable packing strip 1500 includes an internal, inflatable and compressible cavity 1501. Inflatable and compressible cavity 1501 includes a matrix of inflatable bubbles, such as the example bubbles 1503, in some embodiments. As with other bubbles, such as those in conventional bubble wrap, example bubbles 1503 may be used by a shipper, manufacturer or consumer of merchandise to wrap and protect items of merchandise, such as any of the personal care fluid containers set forth in this application (e.g., during shipping). In some embodiments, each of inflatable bubbles 1503 may have a hollow inner void, which may be filled with air, or another gas or fluid, or emptied and flattened out, in different formats in accordance with aspects of the present invention. In some embodiments, each of inflatable bubbles 1503, may be joined to one another (whether directly or through pathways including other inflatable bubbles 1503). Thus, when a consumer takes a flattened version of consumer-inflatable packing strip 1500, in which no air or other gases or fluids have been put into any of inflatable bubbles 1503, or inflatable and compressible cavity 1501, she or he may blow air (e.g., with her or his mouth) into a sealable entrance port 1505, on one side of the consumer-inflatable packing strip 1500 and, once sufficiently inflated to cushion merchandise wrapped within it, the consumer or other user may seal port 1505, for example, with example reversible channel seal 1506, which may be a reversible channel seal known in the art by the brand name ZIPLOC®. In some embodiments, each bubble, or other air-holding chamber, or void of inflatable packing strip 1500, once inflated, may be sealed upon inflation by a user (e.g., by a one-way valve). In some embodiments, inflatable packing strip 1500 is constructed from a puncture-resistant, flexible material, such as polyolefin.

Figure 16:
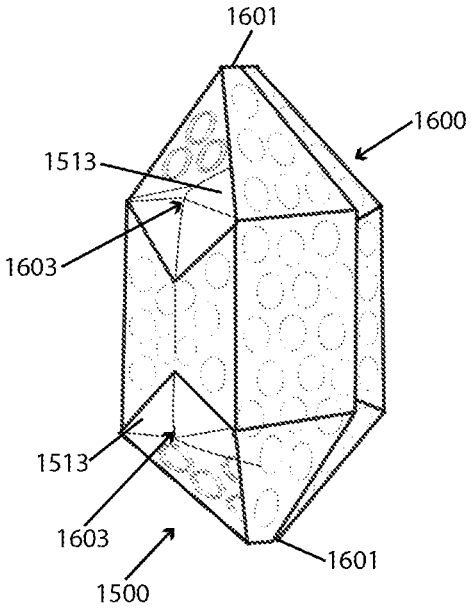
FIG. 16 is a perspective drawing of the same example consumer-inflatable packing strip, discussed above, in an inflated, 3-dimensionally folded and bound state.

In some embodiments, consumer-inflatable packing strip 1500 includes a plurality of substantially identical major sections, such as the example three sections pictured—namely, segment 1507, segment 1508 and segment 1509. In the example provided, each of those segments include an inner inflatable bracket, 1511, which each define $\frac{1}{3}^{rd}$ of a 3D chamber, when inflated and joined together with a piece of merchandise placed within it, holds and protects that merchandise. Thus, in the example provided, each of those brackets include two triangular protrusions, such as the example pictured as 1513, which match and seal together with neighboring protrusions of the other segments, when folded together, as shown in FIG. 16. Similarly, the outer tips 1515, when the segments and folded and taped together (e.g., with preconfigured adhesive tape sections 1517).

In some embodiments, each of compressible inner cavity 1501, example bubbles 1503, and the inflatable brackets are connected together, sharing common voids, with interconnecting hollow channels, such as the example hollow channels shown as 1519. Thus, in some embodiments, a flattened and sealed configuration of consumer-inflatable packing strip 1500 may be sold in pressed and wrapped cylinders, as with ordinary tape, and a user may pay out triplets of segments such as segment 1507, segment 1508 and segment 1509, unseal reversible seal 1506, and blow air into entrance port 1505 and, as a result, inflate all of compressible inner cavity 1501, example bubbles 1503, and the inflatable brackets, in one breath (if consumer-inflatable packing strip 1500 is at a small enough scale, such as the scale for protecting personal care fluid containers, set forth in this application, in accordance with further aspects set forth below.

As mentioned above, FIG. 16 is a perspective drawing of the same example consumer-inflatable packing strip 1500, discussed above, in an inflated, 3-dimensionally folded and bound state 1600. As also mentioned above, in such a an inflated, 3-dimensionally folded and bound state, all of the outer tips 1515 have been conjoined together to form a protective stellation 1601, which, together with example inflated bubbles 1602, and inflated brackets 1603 (formed by inflating the brackets such as 1511, previously shown in a flattened state, serves to cushion items stowed and wrapped at the center of consumer-inflatable packing strip 1500, within the conjoined brackets, such as the examples now shown as 1603. The 3D state shown, also creates various protective struts, voids and pockets, and additional protective stellations, such as the examples pictured as stellations 1605, in some embodiments.

It should be understood that, although the example of stellated segments is provided, any number of additional foldable, self-conjoinable 2D shapes may be used, while carrying out aspects of the present invention. For example, in some embodiments, any shape that can form a 3-dimensionally cushioning, tessellated, or partially tessellated protective structure may, instead, be uses. Similarly, in some embodiments additional or alternative forms of adhesives, instead of or in addition to the example adhesive tape sections 1517, may be used to bind segments and other components of consumer-inflatable packing strips such as those disclosed herein together, and aid in wrapping, protecting and shipping merchandise. For example, in some embodiments, all or substantially all of one side of the flat form shown in FIG. 15, may be covered with an adhesive, and consumer-inflatable packing strip 1500 may be first taped to and wrapped around an item to be shipped, and then inflated as set forth above.

Figure 17:
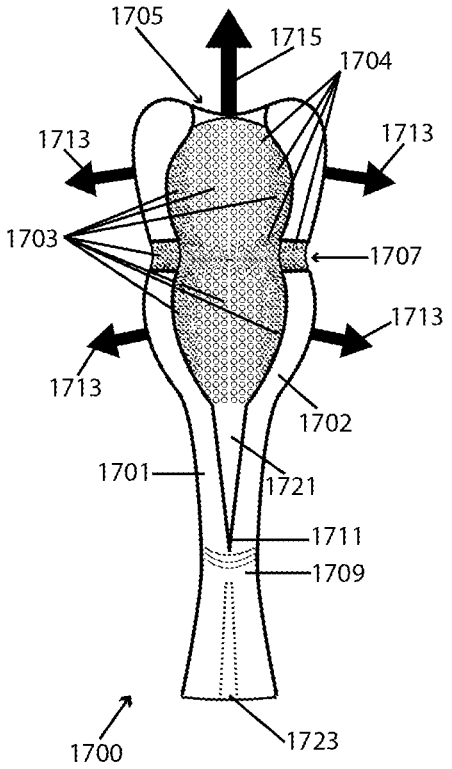
FIG. 17 is a front view of a new form of electric toothbrush brushing head, with flexible, moving lateral brushing arms, in accordance with embodiments of the present invention.

FIG. 17 is a front view of a new form of electric toothbrush brushing head 1700, with flexible, moving lateral brushing arms, such as example left-side lateral brushing arm 1701, and example right-side lateral brushing arm 1702, in accordance with embodiments of the present invention. As with other brushing heads set forth in this application, example brushing head 1700 includes several brushes 1703, comprising a plurality of bristles, such as the examples shown as bristles 1704, lining part of interior teeth-accepting channels, such as example wide teeth accepting channel 1705, and example narrow-teeth accepting channel 1707. in some embodiments. Unlike other brushing heads, however, the base 1709 of brushing head 1700 divides into two segments—namely left-side lateral brushing arm 1701, and example right-side lateral brushing arm 1702, at a vertical point 1711. By so dividing, and due to the flexibility of left-side lateral brushing arm 1701, and example right-side lateral brushing arm 1702, allows them to open up, spreading in the rotational directions indicated by movement-indicating arrows 1713, when teeth wider than the width of channel 1705 enter channel 1705 (e.g., when brushing head is moved over a user's wider teeth in the direction shown by movement-indicating arrow 1715. And by so dividing at vertical point 1711, some distance from the brushes 1703, in combination with the bending, spring-like force of left-side lateral brushing arm 1701, and right-side lateral brushing arm 1702 the resulting widening (and return) of the two arms is slightly milder, yet similar around a lower tooth-accepting pocket 1717 than around a higher tooth-accepting pocket 1719 of brushing head 1700, each being formed laterally by brushes lining the inside of one of the two brushing heads. In some embodiments, the size and difference in widening of the two pockets is selected to match an average difference between neighboring teeth, in a user's line of teeth, as discussed in greater detail above. As a side benefit, being an elastic leaf spring in nature, each of the example left-side lateral brushing arm 1701, and example right-side lateral brushing arm 1702 will exert a relatively constant, ideal level of lateral brushing pressure, as a user utilizes brushing head 1700. In some embodiments, the contours of the brushes lining example left-side lateral brushing arm 1701, and example right-side lateral brushing arm 1702 conform to a user's, or class of users' (e.g., small, medium or large) average teeth to be placed within channel 1705.

It should be mentioned that a third, wider arm 1721, is also included in some embodiments of brushing head 1700, and similarly is lined with brush(es) formed by bristles, contoured to match a user's teeth, in some embodiments. In some embodiments, the brushes lining wider arm 1721 form the bottom of channel 1705. In some embodiments, the width of that channel bottom is variable in exposure by the spreading and rebounding left-side lateral brushing arm 1701, and example right-side lateral brushing arm 1702, to clean a wide variety of surface areas of the distal (biting) surfaces of a user's teeth. In other words, wider arm 1721, and example left-side lateral brushing arm 1701 and example right-side lateral brushing arm 1702, are preferably not directly attached to one another. Instead, they are preferably, all three arms, attached at some point distant from the brushes they are lined with, such as vertical point 1711. In some such embodiments, therefore, some of the brush(es) and bristles lining teeth-accepting channel 1705 are temporarily covered, and uncovered, to clean the bottoms of teeth, as different sized teeth enter channel 1705. Again, as with example left-side lateral brushing arm 1701, and example right-side lateral brushing arm 1702, the leaf-spring nature of wider arm 1721 allows it to exert a relatively constant, pre-determined reactive scrubbing pressure against the surfaces of the users' teeth it is cleaning and/or treating. In some embodiments, any of the arms, such as example left-side lateral brushing arm 1701, and example right-side lateral brushing arm 1702 and wider arm 1721, include a resilient, spring material, such as a rubber, hard plastic, metal, or rubberized material.

As with other electric toothbrush brushing heads set forth in the present application, it is within the scope of this invention that brushing head 1700 may be fastened, and detached, from a peg or other structure attached to an actuator (e.g., vibrating and/or linear actuator) via a peg acceptor 1723, or other fastener.

Any aspects set forth for any brushing head set forth in the present application may be combined with any other aspects of any other brushing head, in various, virtually unlimited possible combinations and embodiments falling within the scope of the invention.

Figure 18:
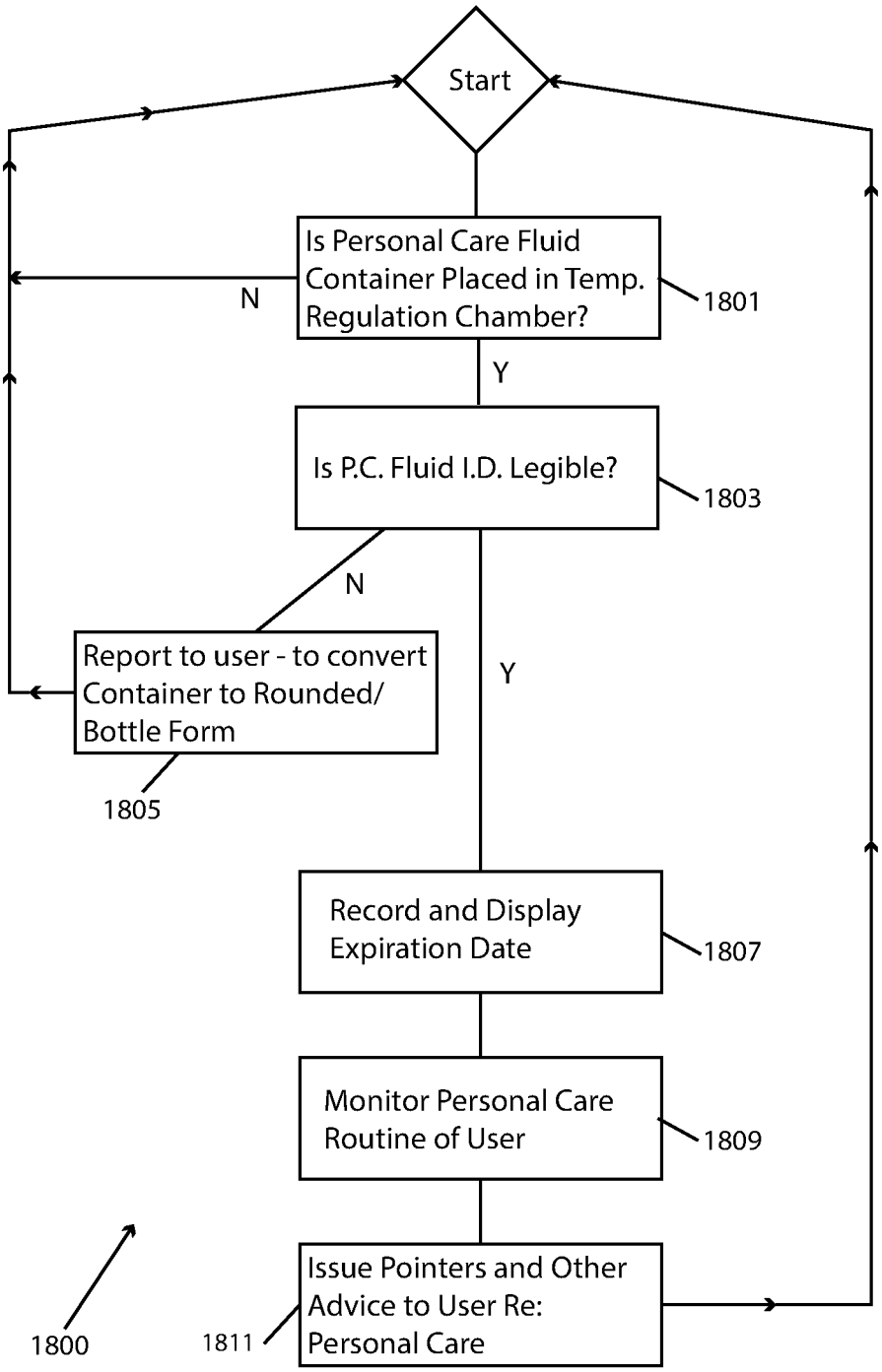
FIG. 18 is a process flow diagram, setting forth several example steps that may be undertaken by a control system (such as the example control system set forth above, in reference to FIG. 13) implementing inventory management and other methodological aspects of the present invention, according to some embodiments.

FIG. 18 is a process flow diagram, setting forth several example steps 1800 that may be undertaken by a control system (such as the example control system set forth above, in reference to FIG. 13) implementing inventory management and other methodological aspects of the present invention (e.g., through software and/or firmware), according to some embodiments. In some embodiments, steps 1800 may be carried out by a control system comprising, or comprised within, a usage-tracking personal care container shelf system (such as example multi-compartment, refrigerating shelf system 1101, discussed in reference to figures above). As with any other method or process embodiments set forth in the present application, the example processes set forth herein, and steps 1800, are only examples, among virtually unlimited possible alternative and additional steps, which may be implemented to carry out aspects of the inventions set forth, as will be readily apparent to those of ordinary skill in the art. Similarly, and also as will be so readily apparent, any of the steps 1800, and such alternative and additional steps thereto, may be carried out in a wide variety of alternative orders, and numbers of steps, which may differ and/or repeat in subsequent cycles of the processes set forth herein, while still falling within the scope of the invention. Although the example of a control system carrying out many of steps 1800 is provided, it should be understood that a user, machine, entity or actor other than the control system may carry out any or all of the steps 1800 in alternative embodiments.

At step 1801, a determination is made (e.g., by the control system) as to whether a personal care fluid container has been placed within a control system regulated chamber, such as any of the plurality of substantially-separated compartments 1105, discussed above. In some embodiments, sensor(s) (e.g., object recognition sensor(s), proximity sensors or camera(s)) within or in communication with the control system may sense the presence of an object matching or resembling a personal care fluid container within such a chamber, to make such a determination, in step 1801. If such a personal care fluid container is not so detected, the control system may restart. If, however, such a personal care fluid container is so detected, the control system proceeds to step 1803, in some embodiments. In step 1803, the control system may further attempt to determine the type and/or unique identity of the personal care fluid container, e.g., by attempting to read a unique label and/or code written on or within the personal care fluid container. As discussed elsewhere in more detail, in some embodiments, the control system may maintain one or more databases, in some embodiments, recording data and information related to such unique label(s) and/or code(s), and associate those data and information with particular users to whom such a personal care fluid container has been provided (e.g., through physical mailing systems, such as a commercial shipping company). Such databases may be supplemented with additional data gathered and created by the control system, and associated with the personal care fluid container, personal care fluids within it, the associated user, and particular personal care routine(s), as is explained in greater detail in this application. If the control system cannot read such a unique label(s) and/or code(s) (e.g., because the label(s) and/or code(s) are illegible, being in a hidden form due to the personal care fluid container being in a flattened, rather than bottle-like shape, as discussed for switchable format personal care fluid containers set forth above), the control system may issue a warning and/or instruction to the user, in step 1805. For example, in some embodiments, in step 1805, the control system may create a written instruction to the user to switch and convert the personal care fluid container into its bottle-like state, revealing such a label and/or code such that it may be scanned and/or read, and then placed back into the chamber, on main graphical display 1201 (e.g., instructing the user to "Convert to Bottle Form.") Once so converted and replaced, or if the label and/or code is already read in step 1803, the control system may record receipt of the personal care fluid container, in some embodiments, and may also proceed to subsequent steps and begin to record data and derive information related to the personal care fluid container and a user(s) thereof (e.g., by monitoring the chamber's and personal care fluid's internal temperature over time, and instances of use and consumption of the fluid, as set forth in this application.) If no conversion has been made, or the label and/or code is still not readable, the control system may restart, in some embodiments. However, in some embodiments, the control system may then attempt to identify the personal fluid container by visual appearance, and/or identify the personal care fluid or ingredients within it (e.g., by color, vapor detection and/or spectroscopy), and proceed to step 1807.

For example, in subsequent step 1807, in some embodiments, the control system determines an expiration time, date and/or expiration algorithm related to the personal care fluid held within the personal care fluid container. In some such embodiments, the expiration time, date and/or expiration algorithm may be written on the label read by the control system in step 1803. In some embodiments, the code scanned by the control system in step 1803 may be related to an expiration time, date and/or expiration algorithm on a database within, or connected with, the control system, and the control system may record such an expiration time, date and/or expiration algorithm as data associated with the personal care fluid container and personal care fluid held within it. In some embodiments, an expiration algorithm provides an expiration profile for such a personal care fluid. Such an algorithm is a mathematical expression that describes an expiration time based on a plurality of personal care fluid expiration-impacting factors. In various embodiments, such an algorithm may adjust a projected expiration time based on any of the following, among innumerable other possible factors, with any number of relative weightings: temperature of the personal care fluid over time; length of time the personal care fluid is held at a temperature above a preserving temperature for the personal care fluid; length of time the personal care fluid is held at a preserving temperature for the personal care fluid; length of time the personal care fluid is held at a temperature below a preserving temperature for the personal care fluid; a projected degree of degradation for the personal care fluid at every temperature experienced by the personal care fluid; the length of time the personal care fluid has been exposed to air; the quality of air in contact with the personal care fluid; a projected degree of degradation for the personal care fluid due to exposure to such air; the length of time the personal care fluid has been exposed to light; a spectrum of light to which the personal care fluid is exposed.

In step 1809, the control system records data related to the use of personal care fluid(s) within such personal care fluid container(s), as well as other data related to a user's personal care routine, as discussed elsewhere in this application. As data related to the personal care fluid container and fluid, and a user's use thereof, is recorded, in some embodiments, the control system issues instructions and warnings related to projected expiration times related to the personal care fluid, as they change over time. (In any event, whether or not such an algorithm is applied, an expiration time may be determined by the control system, and displayed to a user, in step 1807.) As also discussed in greater detail above, a wide variety of data related to a user's personal care routine may be recorded and serve as the basis for instructions, warnings and other personal techniques and inventory control managed by the control system, in step 1811. In some embodiments, as a personal care fluid is determined to have an expiration time, or probable expiration time, that will otherwise exceed a shipping arrival time for a new personal care fluid container, the control system automatically orders such a new personal care fluid container, and causes a credit or other account owned by the user to be debited in an amount matching the purchase price and/or shipping cost for such a personal care fluid container shipment. In some such embodiments, a receiving appliance (which may be a usage-tracking personal care container shelf system such as those set forth in this application) may have a receiving dock on wall-mounted side of the appliance which is coupled with an open or openable receiving bay in the wall, and new personal care fluid containers may be directly delivered into the usage-tracking personal care container shelf system without entering the user's personal space on the other side of the wall.

Figure 19A:
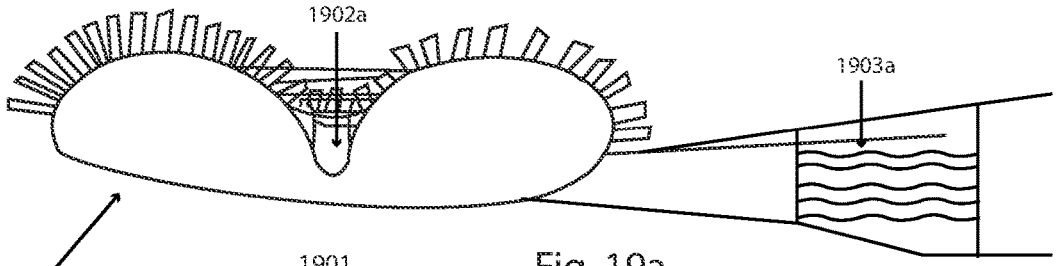
FIG. 19*a* is a side view of an embodiments of a brushing head, showing a more shallow, gently curved channel than that depicted for other brushing heads in the present application.
Figure 19:
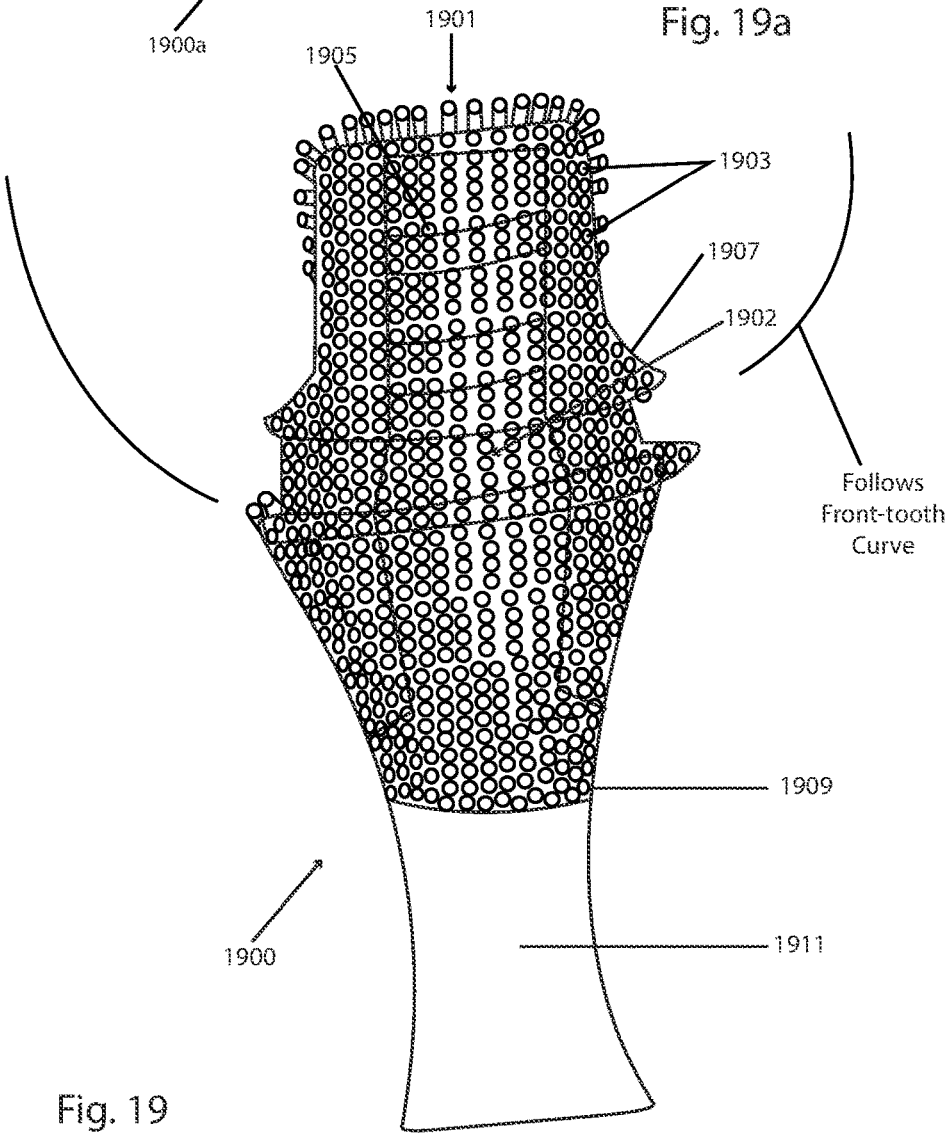
FIG. 19 is a front view of another form of example brushing head, similar in nature to the brushing head set forth with reference to FIGS. 1 and 2, but with a shallower set of teeth-accepting channels, and lined with brushes on its outside surface, to brush additional (e.g., epithelial, mouth) surfaces of a user's oral cavity.

FIG. 19 is a front view of another form of example brushing head 1900, similar in nature to the brushing head set forth with reference to FIGS. 1 and 2, but with a shallower set of teeth-accepting channels 1901 and 1902, and lined with brushes on its outside surface, to brush additional (e.g., epithelial, mouth) surfaces of a user's oral cavity. Unlike with brushing head 103, brushing head 1900 includes outward-facing, exterior bristles 1903 which face in a wide variety of outward directions, including directions opposing the direction that bristles, such as example interior bristles 1905, within teeth-accepting channels 1901 and 1902, extend. Thus, as a user inserts a row of her or his teeth into teeth-accepting channels 1901 and 1902, opposing surfaces 1907 to teeth-accepting channels 1901 and 1902, lined with outward-facing, exterior bristles 1903, may engage with a wide variety of surfaces of a user's mouth, such as the user's tongue and roof of the mouth, even while the user is brushing her or his teeth (within teeth-accepting channels 1901 and 1902). In some embodiments another form of polishing surface, with finer, gentle skin-exfoliating bristles, may line the neck 1909 of brushing head 1900, in a region termed a lip polisher 1911. In some embodiments, a polishing personal care fluid suitable for cleaning, polishing and/or protecting (and, in some embodiments, enhancing the appearance of, e.g., by plumping) the user's lips may be spread onto lip polisher 1911. In some embodiments, such spreading may be caused by a channel leading from (e.g., via a control system actuable pump) an interior tank (not pictured) containing such a fluid within brushing head 1900. In some embodiments, one or more of teeth-accepting channels 1901 and 1902 may each, or either, be curved to match, or approximately match, the curve of a row of the user's teeth to be inserted within it.

FIG. 19*a* is a side view of an embodiments of a brushing head 1900*a*, showing a more shallow channel 1902*a*. Although bristles are not pictured about every surface of brushing head 1900*a*, it should be understood that, in some embodiments, bristles are present on any outward surface of brushing head 1900*a*. Also pictured is an example exfoliating and polishing surface 1903*a*, which may include a polishing texture and/or ridges.

We claim:

1. A refrigerating shelf system for storing and managing personal care products, comprising:

refrigeration hardware comprising a compressor, piezoelectric hardware, a gas-filled tank and a valve and/or other refrigeration hardware;

a plurality of storage compartments, each of said plurality of storage compartments being configured to hold and substantially enclose, respectively, a single non-food, cosmetics personal care product container, and being configured to match, fit and separate each respective single personal care product container from other, similarly sized and shaped personal care product containers;

a computer hardware and software, including a sensor, a processor and a memory, configured to separately observe, and determine information related to, contents of said each respective personal care product container;

wherein said computer hardware and software are configured to infer and record information relating to the personal care routine of a user based on said information related to contents of said each respective personal care product container.

2. The refrigerating shelf system of claim 1, comprising wall-mounting hardware.

3. The refrigerating shelf system of claim 1, wherein said information related to the contents of said personal care product container is an amount or level of a fluid held within said personal care product container.

4. The refrigerating shelf system of claim 1, wherein said information related to the contents of said personal care product container is a quality of a fluid held within said personal care product container.

5. The refrigerating shelf system of claim 1, wherein the system determines a unique identity of said personal care product container.

6. The refrigerating shelf system of claim 5, wherein the system determines a length of time that said personal care product container has been held within one of said plurality of storage compartments.

7. The refrigerating shelf system of claim 5, wherein the system determines a length of time that said personal care product container has been held at a particular temperature (s) within one of said plurality of storage compartments.

8. The refrigerating shelf system of claim 5, wherein the system determines a length of time that said personal care product container has been held within one of said plurality of storage compartments, and wherein temperature of the space within said one of said plurality of storage compartments surrounding said personal care container is monitored.

9. The refrigerating shelf system of claim 7, wherein the system determines a temperature(s) of air exterior to said refrigerating shelf system, and determines a length of time that said personal care product container has been held within said air exterior to said refrigerating shelf system.

10. The refrigerating shelf system of claim 1, wherein each of said plurality of storage compartments is configured to be separately sealed and opened.

11. The refrigerating shelf system of claim 10, wherein each of said plurality of storage compartments is configured to be separately cooled and/or heated.

12. The refrigerating shelf system of claim 1, comprising a plurality of access doors, each of which plurality of access doors is configured to separately seal and provide access to one of said plurality of storage compartments.

13. The refrigerating shelf system of claim 12, wherein each of said plurality of access doors comprises at least one of a plurality of graphical displays comprised in said refrigerating shelf system.

14. The refrigerating shelf system of claim 13, wherein said refrigerating shelf system is configured to display information related to a container held within a compartment sealed by one of said plurality of access doors on one of said graphical displays mounted within said one of said plurality of access doors.

15. The refrigeration shelf system of claim 14, wherein each of said graphical displays comprises product status-indicating multi-color capable indicator light(s).

16. The refrigeration shelf system of claim 1, wherein each of said plurality of storage compartments comprises a bracket with at least one surface matching and/or conforming to an exterior surface of said personal care product container.

17. The refrigeration shelf system of claim 1, comprising a micro-sampling and analysis device, and wherein said personal care product container is configured for extraction of a sample of said contents of said personal care product container by said micro-sampling and analysis device.

18. The refrigeration shelf system of claim 17, wherein said micro-sampling and analysis device comprises a one-way valve or seal preventing the flow of air into said personal care container during sampling by said micro-sampling and analysis device.

19. A usage-tracking personal care container shelf system, comprising:

at least one temperature-regulating sub-device;

a plurality of storage compartments, each of said plurality of storage compartments being configured to hold and substantially enclose, respectively, at least one non-food, cosmetics personal care product container, and being configured to match, fit and separate each of said at least one personal care product container from other, similarly sized and shaped personal care product containers;

a computer hardware and software, including a sensor, a processor and a memory, configured to separately observe, and determine information related to contents of said each respective personal care product container;

wherein said computer hardware and software are configured to infer and record information relating to the personal care routine of a user based on said information related to the contents of said at least one cosmetics personal care product container.

* * * * *